US010777901B2

(12) United States Patent
Franklin et al.

(10) Patent No.: US 10,777,901 B2
(45) Date of Patent: Sep. 15, 2020

(54) FABRY-PEROT CAVITY ANTENNA SYSTEM HAVING A FREQUENCY SELECTIVE SURFACE

(71) Applicant: Regents of the University of Minnesota, Minneapolis, MN (US)

(72) Inventors: Rhonda R. Franklin, Falcon Heights, MN (US); Robert Sainati, Bloomington, MN (US); Chanjoon Lee, Maple Grove, MN (US); Aditya Dave, Minneapolis, MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 51 days.

(21) Appl. No.: 16/269,957

(22) Filed: Feb. 7, 2019

(65) Prior Publication Data

US 2019/0245273 A1 Aug. 8, 2019

Related U.S. Application Data

(60) Provisional application No. 62/627,414, filed on Feb. 7, 2018.

(51) Int. Cl.
*H01Q 15/00* (2006.01)
*H01Q 19/10* (2006.01)
(Continued)

(52) U.S. Cl.
CPC ..... *H01Q 15/0033* (2013.01); *H01Q 3/245* (2013.01); *H01Q 13/10* (2013.01); *H01Q 19/108* (2013.01); *H01Q 21/065* (2013.01)

(58) Field of Classification Search
CPC .. H01Q 15/0033; H01Q 19/108; H01Q 13/10; H01Q 13/18; H01Q 3/245; H01Q 3/44; G01Q 21/065
See application file for complete search history.

(56) References Cited

U.S. PATENT DOCUMENTS 5,917,458 A * 6/1999 Ho ..... H01Q 1/405 343/769
8,730,125 B2 5/2014 De Flaviis et al.
(Continued)

OTHER PUBLICATIONS

Burghignoli et al., "Highly Polarized, Directive Radiation From a Fabry-Perot Cavity Leaky-Wave Antenna Based on a Metal Strip Grating," IEEE Transactions on Antennas and Propagation, vol. 58, No. 12, Dec. 2010, 11 pp.
(Continued)

*Primary Examiner* — Raymond R Chai
(74) *Attorney, Agent, or Firm* — Shumaker & Sieffert, P.A.

(57) ABSTRACT

An antenna system may include a source antenna, a frequency selective surface (FSS), and a second antenna or a fluidic channel associated with a housing. In both examples, the FSS has a first side and a second side opposite from the first side. The first side includes horizontally oriented unit cells positioned as multiple columns of unit cells. The first side of the FSS faces the source antenna and is separated from the source antenna by a defined distance. The housing is positioned on the second side of the FSS. In the latter example, the fluidic channel of the housing includes one of air or deionized water. The fluidic channel is positioned on a portion of the second side of the FSS that is opposite to a subset of the horizontally oriented unit cells on the first side of the FSS.

35 Claims, 23 Drawing Sheets

(51) Int. Cl.

| | |
|---|---|
| ***H01Q 21/06*** | (2006.01) |
| ***H01Q 13/10*** | (2006.01) |
| ***H01Q 3/24*** | (2006.01) |

(56) References Cited

U.S. PATENT DOCUMENTS

2005/0057432 A1* 3/2005 Anderson ..... H01Q 15/006 343/909
2013/0241785 A1* 9/2013 De Flaviis ..... H01Q 13/10 343/767
2019/0115646 A1* 4/2019 Chiu ..... H01Q 15/10

OTHER PUBLICATIONS

Casares-Miranda et al., "Vertical Microstrip Transition for Multilayer Microwave Circuits with Decoupled Passive and Active Layers," IEEE Microwave and Wireless Components Letters, vol. 16, No. 7, Jul. 2006, 3 pp.
Feresidis et al., "High gain planar antenna using optimized partially reflective surfaces," IEEE Proceedings—Microwaves, Antennas and Propagation vol. 148, No. 6, Dec. 2001, 6 pp.
Gardelli et al., "Array Thinning by Using Antennas in a Fabry-Perot Cavity for Gain Enhancement," IEEE Transactions on Antennas and Propagation, vol. 54, No. 7, Jul. 2006, 12 pp.
Ge et al., Broadband and High-Gain Printed Antennas Constructed from Fabry-Perot Resonator Structure using EBG or FSS Cover, Microwave and Optical Technology Letters, vol. 48, No. 7, Jul. 2006, 3 pp.
Godara, "Application of Antenna Arrays to Mobile Communications, Part II: Beam-Forming and Direction-of-Arrival considerations," Proceedings of the IEEE, vol. 85, No. 8, Aug. 1997, 51 pp.
Gu et al., "Modeling and analysis of vias in multilayered integrated circuits," IEEE Transactions on Microwave Theory and Techniques, vol. 41, No. 2, Feb. 1993, 9 pp.
Han et al., "A Millimeter-Wave Fabry-Perot Antenna With High-Gain and Circular Polarization Operation," Proceedings of 2014 3rd Asia-Pacific Conference on Antennas and Propagation, Jul. 2014, 4 pp.
Hosseini et al., "A 63 GHz Single-feed Low-profile Fabry-Perot Cavity Antenna Using a Thick Metallic FSS," 2013 IEEE Antennas and Propagation Society International Symposium (APSURSI), Jul. 2013, 2 pp.
Hosseini et al., "A Highly-efficient Single-feed Planar Fabry-Perot Cavity Antenna for 60 GHz Technology," Proceedings of the 2012 IEEE International Symposium on Antennas and Propagation, Jul. 2012, 2 pp.
Jackson et al., "A Leaky-Wave Analysis of the High-Gain Printed Antenna Configuration," IEEE Transactions of Antennas and Propagation, vol. 36, No. 7, Jul. 1988, 6 pp.
Kelley et al., "Fluidic Tuning of a Frequency Selective Surface Based on a Four-arm Archimedean Spiral," 2013 IEEE Antennas and Propagation Society International Symposium (APSURSI), Jul. 2013, 2 pp.
Kelley et al., "Frequency reconfigurable patch antenna using liquid metal as switching mechanism," Electronic Letters, vol. 49, No. 22, Oct. 2013, 2 pp.
Kim et al., "A Wideband Fabry-Perot Cavity Antenna with Successively Tapered Meandering Loops," Proceedings of the 5th European Conference on Antennas and Propagation (EUCAP), Apr. 2011, 2 pp.
Kim et al., "Fabry-Perot Cavity Antenna With Lateral Metallic Walls for WiBro Base Station Applications," Electronics Letters, vol. 45, No. 3, Jan. 2009, 2 pp.
Konstantinidis et al., "Multilayer Partially Reflective Surfaces for Broadband Fabry-Perot Cavity Antennas," IEEE Transactions on Antennas and Propagation, vol. 62, No. 7, Jul. 2014, 8 pp.
Lee et al., "Analysis of Coplanar Waveguide Feedline Effect on Fabry-Perot Cavity Antenna System Performance," 2016 IEEE International Symposium on Antennas and propagation (SPSURSI), Jun. 2016, 2 pp.
Lee et al., "Comparative Analysis of Frequency Selective Surface Geometry Effect in Fabry-Perot Cavity Antenna Design" 2015 IEEE 16th Annual Wireless and Microwave Technology Conference (WAMICON), Apr. 2015, 4 pp.
Lee et al., "Design of Near-Field Beam-Splitting Frequency Selective Surfaces for Fabry-Perot Cavity Antenna Systems," 2016 46th European Microwave Conference (EuMC), Oct. 2016, 4 pp.
Lee et al., "Fabry-Perot Cavity Antenna System with Beam-Splitting of Near-Field Radiation," 2016 IEEE International Symposium on Antennas and Propagation (APSURSI) Jun. 2016, 2 pp.
Lee et al., "Fluidic Switching and Tuning of Fabry-Perot Antenna" 2015 IEEE International Symposium on Antennas and Propagation USNC/URSI National Radio Science Meeting, Jul. 2015, 2 pp.
Lee et al., "Microfluidic Near-Field Beam-Splitting Frequency Selective Surface for Fabry-Perot Cavity Antenna System," 2017 IEEE International Symposium on Antennas and Propagation & USNC/URSI national radio Science Meeting, Jul. 2017, 2 pp.
Lee et al., "Parametric Study of Near- and Far-Field Performance of the Fabry-Perot Cavity Antenna System," 2016 IEEE 17th Annual wireless and Microwave Technology Conference (WAMICON), Apr. 2016, 3 pp.
Lee et al., "Reconfigurable Frequency Selective Surface for Fabry-Perot Cavity Antenna System," 2017 IEEE International Symposium on Antennas and Propagation & USNC/URSI national radio Science Meeting, Jul. 2017, 2 pp.
Liu et al., "Power consumption estimation in CMOS VLSI chips," IEEE Journal of Solid-State Circuits, vol. 29, No. 6, Jun. 1994, 8 pp.
Lu et al., "Design and Implementation of Broadband Partially Reflective Surface Antenna," 2011 IEEE International Symposium on Antennas and propagation (APSURSI), Jul. 2011, 4 pp.
Mateo-Segura et al., "Analysis of Broadband Highly-Directive Fabry-Perot Cavity Leaky-Wave Antennas with Two Periodic Layers," 2010 IEEE Antennas and Propagation Society International Symposium, Jul. 2010, 4 pp.
Murray et al., "Frequency tunable annular slot antenna," 2013 IEEE Antennas and Propagation Society International Symposium (APSURSI), Jul. 2013, 2 pp.
Pavuluri et al., "Integration of Microfluidic Channels with Frequency Selective Surfaces for Sensing and Tuning," The 8th European Conference on Antennas and Propagation (EuCAP 2014), Apr. 2014, 4 pp.
Saghati et al., "A Microfluidically-Tuned Dual-Band Slot Antenna," 2014 IEEE Antennas and Propagation Society International Symposium (APSURSI), Jul. 2014, 2 pp.
Sarabandi et al., "A Frequency Selective Surface with Miniaturized Elements," IEEE Transactions on Antennas and Propagation, vol. 55, No. 5, May 2007, 7 pp.
Shrestha et al., "Two Antenna Arrays for Remote Sensing Applications," 2017 IEEE Aerospace Conference, Mar. 2017, 9 pp.
Theodorou et al., "Transition Properties of a Vertical Conductor Connecting Two Microstrip Lines at Different Planes," IEEE Transactions on Microwave Theory and Techniques, vol. 42, No. 12, Dec. 1994, 8 pp.
Yanfei et al., "A Novel Design for a Low Profile High Directivity Fabry-Perot Cavity Antenna," 2009 IEEE Antennas and Propagation Society International Symposium, Jun. 2009, 4 pp.
Zhou et al., "Fabry-Perot Resonator Antenna with High Aperture Efficiency Using a Double-Layer Nonuniform Superstrate," IEEE Transactions on Antennas and Propagation, vol. 66, No. 4, Apr. 2018, 6 pp.
"Users Manual & Setup Guide—Desktop Antenna Measurement System (DAMS) x000, x100, and x250 Series," Diamond Engineering, 2013, 104 pp. (Applicant points out, in accordance with MPEP 609.04(a), that the year of publication, 2013, is sufficiently earlier than the effective U.S. filing date, so that the particular month of publication is not in issue.).

(56) References Cited

OTHER PUBLICATIONS

"User's Guide—High Frequency Structure Simulator (HFSS)," Version 10, Ansoft Corporation, Jun. 2005, 801 pp. (Uploaded in 2 parts).

* cited by examiner (a) No PDMS (b) Air inside PDMS (a) FSS-1V

FABRY-PEROT CAVITY ANTENNA SYSTEM HAVING A FREQUENCY SELECTIVE SURFACE

RELATED APPLICATIONS

This application claims the benefit of U.S. Provisional Patent Application No. 62/627,414, filed on Feb. 7, 2018 and entitled "RECONFIGURABLE MICROFLUIDIC FABRY-PEROT CAVITY ANTENNA SYSTEM HAVING A FREQUENCY SELECTIVE SURFACE," the entire content of which is hereby incorporated by reference.

GOVERNMENT INTEREST

This invention was made with government support under ECCS-1202329 and ECCS-1509543, awarded by National Science Foundation. The government has certain rights in the invention.

TECHNICAL FIELD

The present disclosure relates to antenna systems.

BACKGROUND

Trends to provide users with ubiquitous access to multiple radio terminals in wireless communication have been growing. As a result, reconfigurable radio platforms are being developed and advanced to address this need. In addition, as system complexity increases, efforts to create more energy efficient designs are required. Fabry-Perot Cavity (FPC) antenna systems offer the ability to beamform a source signal.

SUMMARY

The present disclosure describes techniques for utilizing a fluidic structure to alter a frequency selective surface (FSS) structure of an antenna system, such as a cavity-backed Fabry-Perot Cavity (FPC) antenna system. The use of such a fluidic structure may result in beam-splitting or beam-focusing with respect to near- and/or far-field performance of the antenna system. A fluidic channel in the fluidic structure may be integrated into the antenna system. This fluidic channel may be filled with deionized water or air, as examples. As one example implementation, when the channel is filled with deionized water, the antenna system is configured to operate in a beam-splitting mode, and when the channel is filled with air, the antenna system is configured to operate in a beam-focusing mode. The antenna system may be configurable to switch from one mode to the other and may use other example fluids.

The present disclosure further describes techniques for providing novel free space vertical interconnects using an antenna system in the near field for various applications (e.g., 60 GHz and higher applications). FPC antenna systems offer the ability to beamform a source signal for remote communication between devices as well as focus energy in the near field for near-field communications with low power consumption. In some examples, the antenna system includes a patch antenna transmitter that communicates with a patch antenna receiver via an FSS. In some examples, the antenna system includes a slot antenna transmitter that communicates with a patch antenna receiver via an FSS. In some examples, one or more horn antennas may also be used in the system (e.g., as the transmitter), and/or any other form of radiating element that outputs beams that are orthogonal to a surface of the FSS. Vertical interconnects are being used extensively with aggressive scaling of device geometries and in three dimensional (3D) integrated systems (e.g., stacked backplanes in servers, substrate integrated packaging, 3D integrated circuits, silicon integrated circuits for digital and/or analog design) to obtain more performance from a limited area. In some cases, at the system level, wireless interconnects can be used to communicate between multi-chip systems. The inter-chip interconnects may enable chip-to-chip communication and introduce an energy efficient, high bandwidth unified communication architecture into homogeneous, heterogeneous and memory intensive multi-chip systems. One or more techniques disclosed herein describe a novel free space interconnect design that is based on an FPC antenna design to couple its near field focusing beam to a nearby receive antenna through a cavity. The design may, in various cases, provide a low loss solution to vertical interconnects that enhance signal transmission and reduce signal degradation and bandwidth limitation.

In one example, an antenna system includes a source antenna, a frequency selective surface (FSS), and a housing. The FSS has a first side and a second side opposite from the first side, the first side of the FSS including a plurality of horizontally oriented unit cells, and the horizontally oriented unit cells being positioned in multiple columns of unit cells on the first side of the FSS. The first side of the FSS faces the source antenna, and the first side of the FSS is separated from the source antenna by a defined distance. The housing includes a fluidic channel, and the housing is positioned on the second side of the FSS. The fluidic channel includes one of air or deionized water, and the fluidic channel is positioned on a portion of the second side of the FSS that is opposite to a subset of the horizontally oriented unit cells on the first side of the FSS.

In one example, a method includes configuring an antenna system to operate in a first mode, wherein the first mode comprises one of a beam-splitting mode or a beam-focusing mode. The antenna system includes a source antenna, a frequency selective surface (FSS), and a housing. The FSS has a first side and a second side opposite from the first side, the first side of the FSS including a plurality of horizontally oriented unit cells, and the horizontally oriented unit cells being positioned in multiple columns of unit cells on the first side of the FSS. The first side of the FSS faces the source antenna, and the first side of the FSS is separated from the source antenna by a defined distance. The housing includes a fluidic channel, and the housing is positioned on the second side of the FSS. The fluidic channel includes one of air or deionized water, and the fluidic channel is positioned on a portion of the second side of the FSS that is opposite to a subset of the horizontally oriented unit cells on the first side of the FSS. The example method further includes, subsequent to the antenna system operating in the first mode for a duration of time, reconfiguring the antenna system to operate in a second mode, wherein the second mode comprises one of the beam-splitting mode or the beam-focusing mode, and wherein the second mode is different from the first mode. Configuring the antenna system to operate in the first mode and reconfiguring the antenna system to operate in the second mode each comprise filling the fluidic channel of the housing with one of air or deionized water.

In one example, an antenna system includes a transmit antenna that is configured to emit radiation, a frequency selective surface (FSS), a receive antenna, and an enclosure that is configured to at least partially enclose the transmit antenna, the FSS, and the receive antenna. The FSS has a first side and a second side opposite from the first side, wherein the first side of the FSS faces the transmit antenna and includes a plurality of horizontally oriented unit cells, wherein the first side of the FSS is separated from the transmit antenna by a first defined distance, and wherein at least a portion of the radiation emitted by the transmit antenna passes through the plurality of horizontally oriented unit cells. The plurality of horizontally oriented unit cells includes one or more groups of cells that each includes multiple columns of one or more horizontally oriented unit cells. The receive antenna that is configured to receive at least the portion of the radiation that passes through the plurality of horizontally oriented unit cells of the FSS, wherein the receive antenna faces the second side of the FSS and is separated from the second side of the FSS by a second defined distance, and wherein the FSS is positioned between the transmit antenna and the receive antenna.

In one example, a method of providing wireless communication in an antenna system includes emitting, by a transmit antenna of the antenna system, radiation that at least partially passes through a frequency selective surface (FSS) having a first side and a second side opposite from the first side, wherein the first side of the FSS faces the transmit antenna and includes a plurality of horizontally oriented unit cells, wherein the first side of the FSS is separated from the transmit antenna by a first defined distance, wherein at least a portion of the radiation emitted by the transmit antenna passes through the plurality of horizontally oriented unit cells, and wherein the horizontally oriented unit cells include one or more groups of cells that each includes multiple columns of one or more horizontally oriented unit cells. The example method further includes receiving, by a receive antenna of the antenna system, at least the portion of the radiation that passes through the plurality of horizontally oriented unit cells of the FSS, wherein the receive antenna faces the second side of the FSS and is separated from the second side of the FSS by a second defined distance, and wherein the FSS is positioned between the transmit antenna and the receive antenna.

The details of one or more examples of the disclosure are set forth in the accompanying drawings and the description below. Other features, objects, and advantages of the disclosure will be apparent from the description and drawings, and from the claims.

DETAILED DESCRIPTION

Figure 1A:
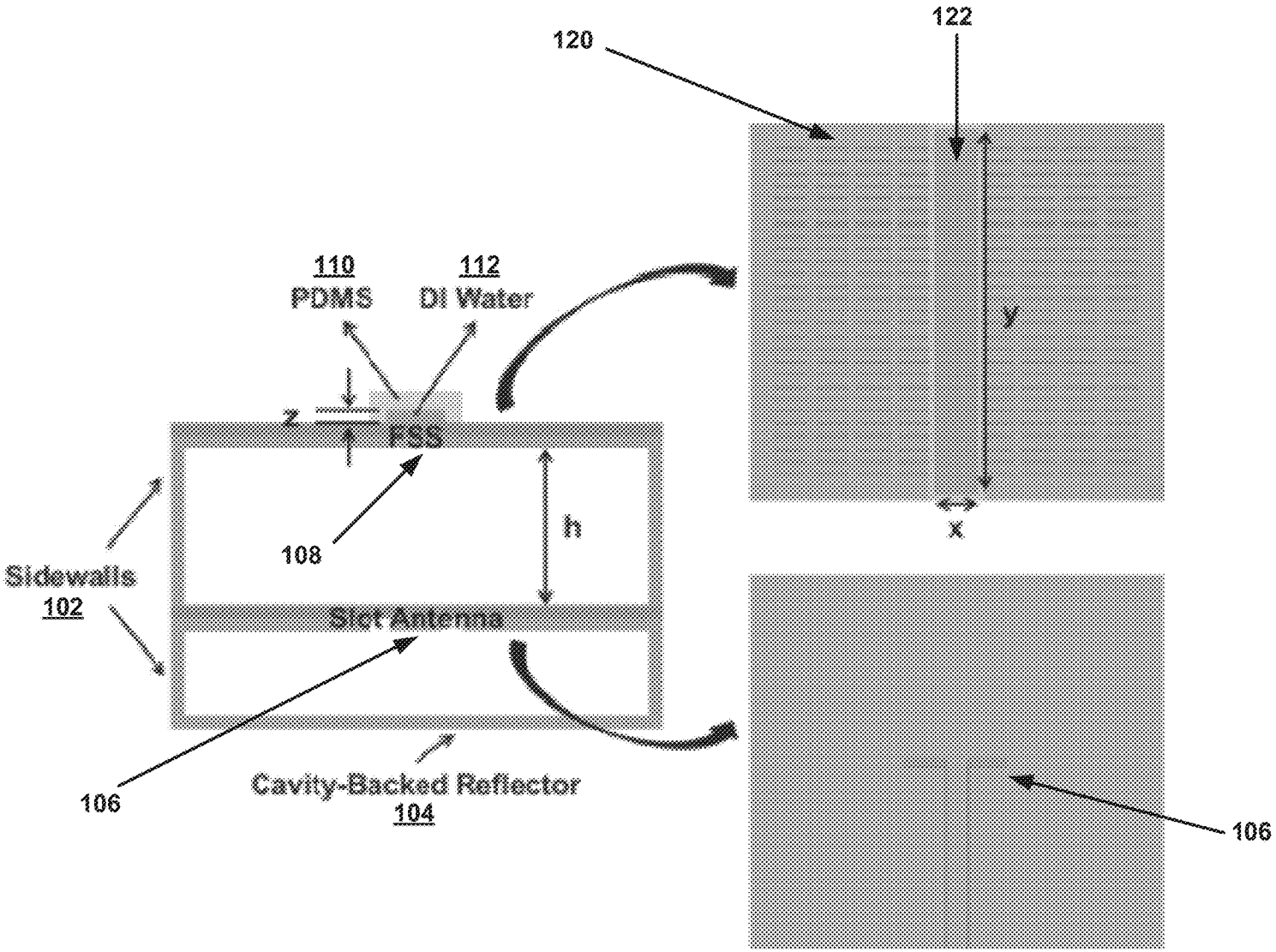
FIG. 1A is a diagram illustrating an example structure of a cavity-backed Fabry-Perot Cavity (FPC) antenna system with a frequency selective surface (FSS) and polydimethylsiloxane (PDMS) channel, in accordance with one or more aspects of the present disclosure.

Fabry-Perot Cavity (FPC) antenna systems may be used to create highly directive beamforming using a single source and a frequency selective surface (FSS). Rather than utilizing complex integration of switches and associated circuitry to change the surface, however, implementations using fluidic channels are described herein.

For example, the present disclosure presents reconfigurable FPC antenna systems to switch one mode to other with respect to near- and far-field performance. The fluidic channel is created and integrated into the FPC system. The channel is filled with air or deionized water. A pump (e.g., an electromechanical pump, a syringe, or the like), which may be included in or external to the FPC system, may push one of air or deionized water into, or expel one of air or deionized water from, the FPC system. In some examples, the pump may be operatively coupled to one or more of an air reservoir or a deionized water reservoir. A controller may control the operations of the pump and may, in some examples, control whether the pump is pushing air into the FPC system, expelling air from the FPC system, pushing deionized water into the FPC system, or expelling deionized water from the FPC system (e.g., controlling a mode of operation of the pump and/or FPC system, such as a beam-splitting mode when using deionized water or a beam-focusing mode when using air in the FPC system). The fluidic FPC systems are compared to a fixed FPC design without the fluidic housing. Simulation and measurement results are presented and discussed. In some examples, a microfluidic FPC antenna system is presented with split beam in the near-field. For this purpose, a fluidic housing, which is made of polydimethylsiloxane (PDMS), is used and integrated into the FPC system. The FPC system includes an antenna (e.g., slot antenna, unidirectional or bidirectional) and an FSS.

One of more techniques of the present disclosure describe the use of microfluidics to alter an FSS structure to achieve beam-splitting or beam-focusing. The split beam can also offer the potential to provide near-field energy to chip-to-chip communication and/or board-to-board communication. The splitting may allow for a more directive far-field beam-width if the split beam parameters are controlled, and a comparison of a uniform FSS to one loaded with a dielectric cavity to house air or deionized water described herein. The near-field and far-field responses are compared in simulation and measurement with discussion on the implications of using fluids to alter the FSS.

One or more techniques of the present disclosure also describe free space vertical interconnects using near-field coupling of antennas in an FPC system. Vertical interconnects are being used extensively with aggressive scaling of device geometries and in three-dimensional (3D) integrated systems to obtain more performance from a limited area. Vias are popular solutions, but as circuit layers increase, so do fabrication challenges and higher frequency performance degradation. A novel free space vertical interconnect solution is described herein using Fabry-Perot-Cavity antenna system in the near field for, e.g., 60 GHz (and higher) applications. In non-limiting examples, a 12 GHz scaled model is demonstrated that couples two patch antennas through an FSS, although, in other examples, a patch antenna and a slot antenna may be used, and/or any other form of radiating element that outputs beams that are orthogonal to a surface of the FSS. In these particular examples, the 12 GHz operational model of this system gives an insertion loss of 1.34 dB and high isolation. When compared to a two layer via for microstrip lines, the described measured solution is 2.64 dB better. It is also close to the through line insertion loss which measures 0.8 dB, providing a reduced complexity packaging solution.

When it comes to low power integrated system designs, interconnects play a role in their operation. Vertical interconnects may be used for 3D integration in backplanes, substrate integrated packaging, and 3D integrated circuits, to name a few examples. The losses associated with these structures may, however, increase power consumption, degrade signal integrity due to dispersion effects, and introduce parasitic effects that hinder bandwidth performance.

At the system level, wireless interconnects can be used to communicate between multi-chip systems. The inter-chip interconnects introduce an energy efficient, high bandwidth unified communication architecture into homogeneous, heterogeneous and/or memory intensive multi-chip systems. 60 GHz designs have been demonstrated with a worst-case transmission coefficient of around −35 dB. Interconnects can also be used at the circuit level but small antenna gains may, in some cases, increase the need for additional active circuits to boost the gain. To overcome low signaling, spiral antennas have been used for their inductive mutual coupling to transfer power, but the trade-off is high crosstalk with nearby chips because of the wireless nature. Techniques of the present disclosure describe a novel free space interconnect design that is based on a Fabry-Perot Cavity Antenna (FPCA) system that couples its near field focusing beam to a nearby receive antenna through a cavity, providing a low-loss solution to vertical interconnects that enhances signal transmission and reduces signal degradation and bandwidth limitation. These solutions may be implemented in silicon integrated circuits for digital and analog circuit design, along with stacked backplanes in servers, to name a few examples.

Referring to the one of more techniques of the present disclosure that describe the use of microfluidics to alter an FSS structure, reference is made to FIG. 1. Regarding the reconfigurability of an FPC system, a cavity-backed FPC antenna system (e.g., with a cavity-backed reflector 104), with and without a fluid channel housing, is considered as shown in FIG. 1A. The FPC system includes of (i) source antenna 106 (e.g., slot antenna), (ii) an FSS array 108, and (iii) a fluidic channel 122. A 1λ-slot antenna 106 is used as a source and a design of FSS array 108 has all rectangular apertures or cells 120.

A coplanar waveguide (CPW)-fed slot antenna 106 may be designed and employed as a single source. The FSS design includes 9 by 27 rectangular unit cells 120 (i.e., 9 columns of cells, each column have 27 individual cells), and is referred to as FSS 108 with all horizontally oriented unit cells (FSS-AH). In the example of FIG. 1A, each unit cell is 10 mm by 3 mm and has a rectangular aperture length of 8 mm and width of 0.5 mm. A rectangular aperture may be positioned (e.g., centered substantially in the middle) of a respective unit cell. Each column is approximately 10 mm wide.

Figure 1B:
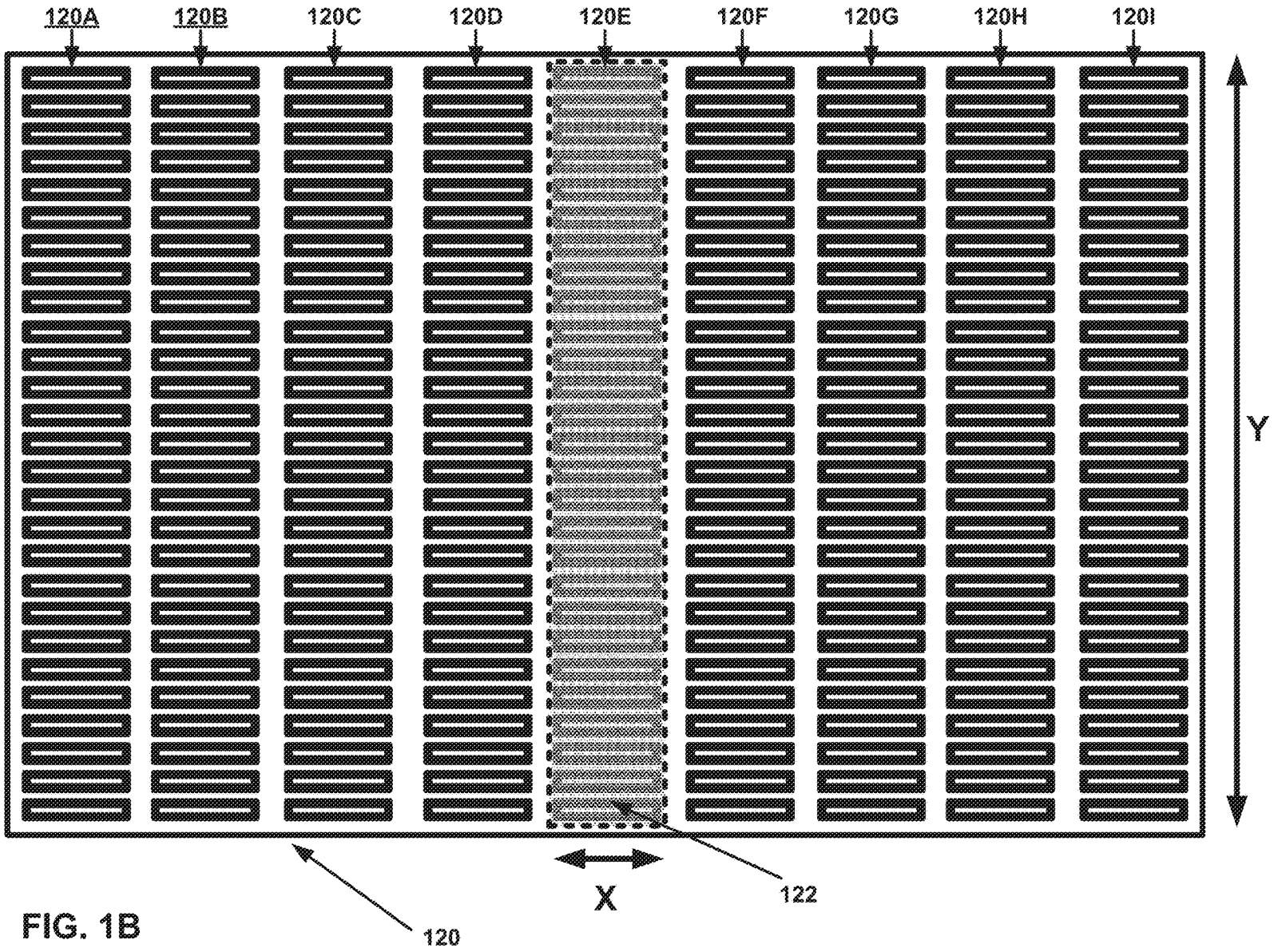
FIG. 1B is a diagram illustrating an exploded view of the FSS shown in FIG. 1A, in accordance with one or more aspects of the present disclosure.

The fluidic channel or housing 122 is made of PDMS 110 and localized in the center of the FSS-AH array. The volume of inner housing containing fluid (x×y×z) is $10\times87\times1$ mm$^3$. The FSS-AH has all horizontally oriented unit cells 120 on one surface and the fluidic channel 122 is localized along the center on the other surface. For example, as shown in FIG. 1A, there are 9 columns of horizontally oriented unit cells in the FSS-AH design, where each column includes 27 of the horizontally oriented unit cells. These cells are located on one side of FSS 108. Fluidic channel 122 inside PDMS housing 110 is located on an opposite side of FSS 108 with respect to these unit cells 120. As indicated in FIG. 1A, fluidic channel 122 has dimensions (x×y) such that it is opposite from one of the columns of unit cells 120, and, more particularly, opposite from the center-most column of unit cells 120 in the FSS-AH design. In various examples, the dimension (length y) of fluidic channel 122 is at least as large as the column length of 27 horizontally oriented unit cells, and the dimension (width x) of fluidic channel 122 is at least as large as the width of one column of horizontally oriented unit cells 120, such that fluidic channel 122 covers the portion of the side of FSS 108 that is opposite from this particular column of cells in the FSS-AH. FIG. 1B shows an exploded view of the FSS-AH structure, including the apertures included in each of the nine columns 120A-1201 of horizontally oriented unit cells 120. These cells 120 are positioned on one side of FSS 108, while fluidic channel 122 is positioned on the other side of FSS 108, substantially opposite middle column 120E of cells (e.g., substantially in the center of FSS 108).

Referring again to the example of FIG. 1, fluidic channel or housing 122 is filled with air or deionized water 112. Deionized water is a highly absorptive fluid with resistivity (ρ) of 18.2 MΩ-cm. Deionized water is used to absorb leaked energy from the FSS and to split the beam in the near-field. To avoid energy leakage around the FPC, metallic sidewalls 102 and reflector 104 are combined with the source and FSS array. In the example of FIG. 1A, the separation height (h) between source antenna 106 and FSS 108 is chosen to be 10.81 mm to optimize beamforming. Designs are fabricated on RT/Duroid5880 ($\varepsilon_r$=2.2, tan δ=0.0009, substrate height=1.57 mm). The metal side of antenna 106 and FSS 108 both point downward in FIG. 1A, towards cavity-backed reflector 104.

Figure 2A:
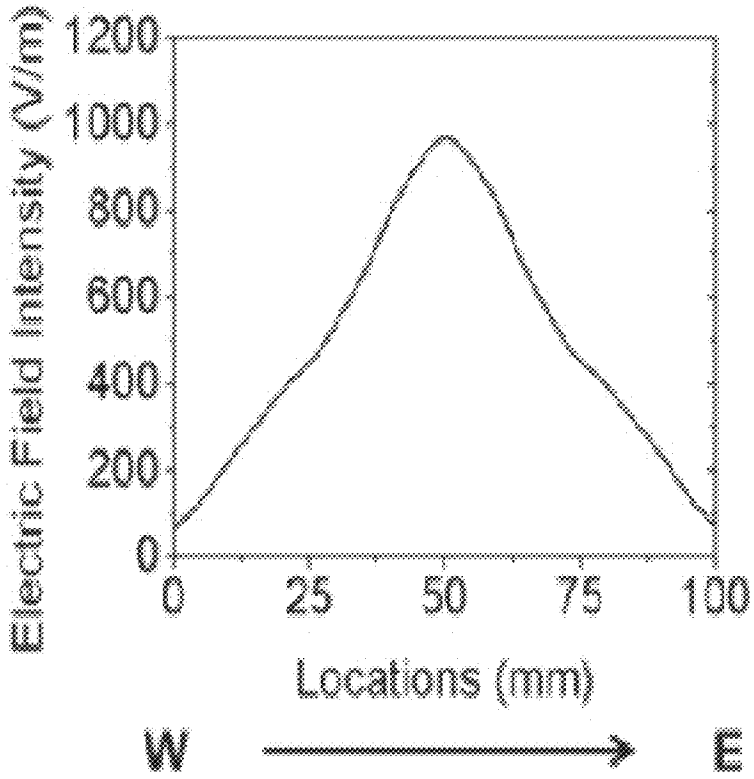
FIG. 2A is a diagram illustrating an example near-field distribution at 11.2 Gigahertz (GHz) above the FSS (left) and electric field intensity along the West-East line (right), in an example FPC antenna system having no PDMS, in accordance with one or more aspects of the present disclosure.
Figure 2A:
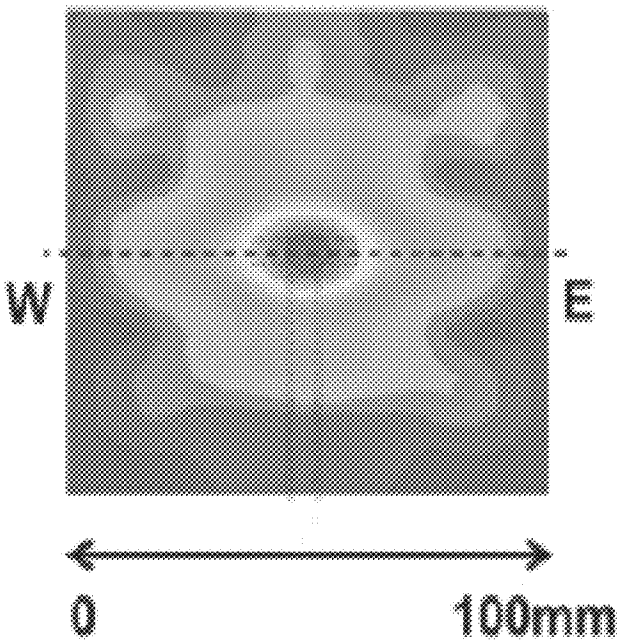
Figure 2B:
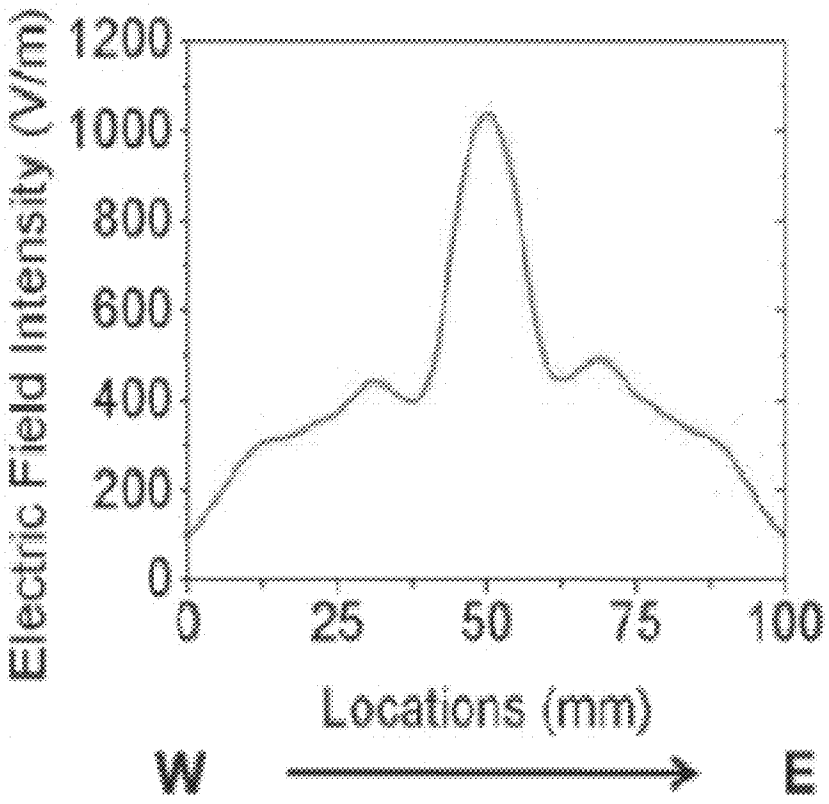
FIG. 2B is a diagram illustrating an example near-field distribution at 11.2 Gigahertz (GHz) above the FSS (left) and electric field intensity along West-East (right), in an example FPC antenna system having air inside the PDMS, in accordance with one or more aspects of the present disclosure.
Figure 2B:
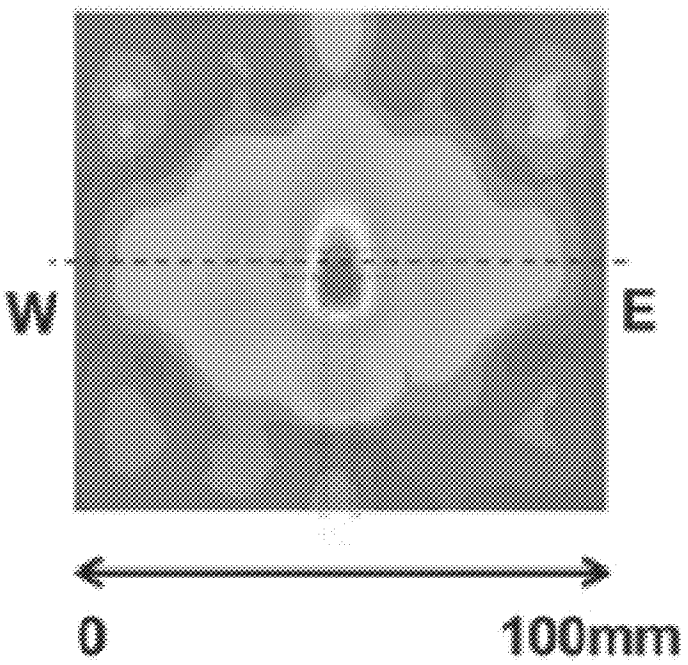
Figure 2C:
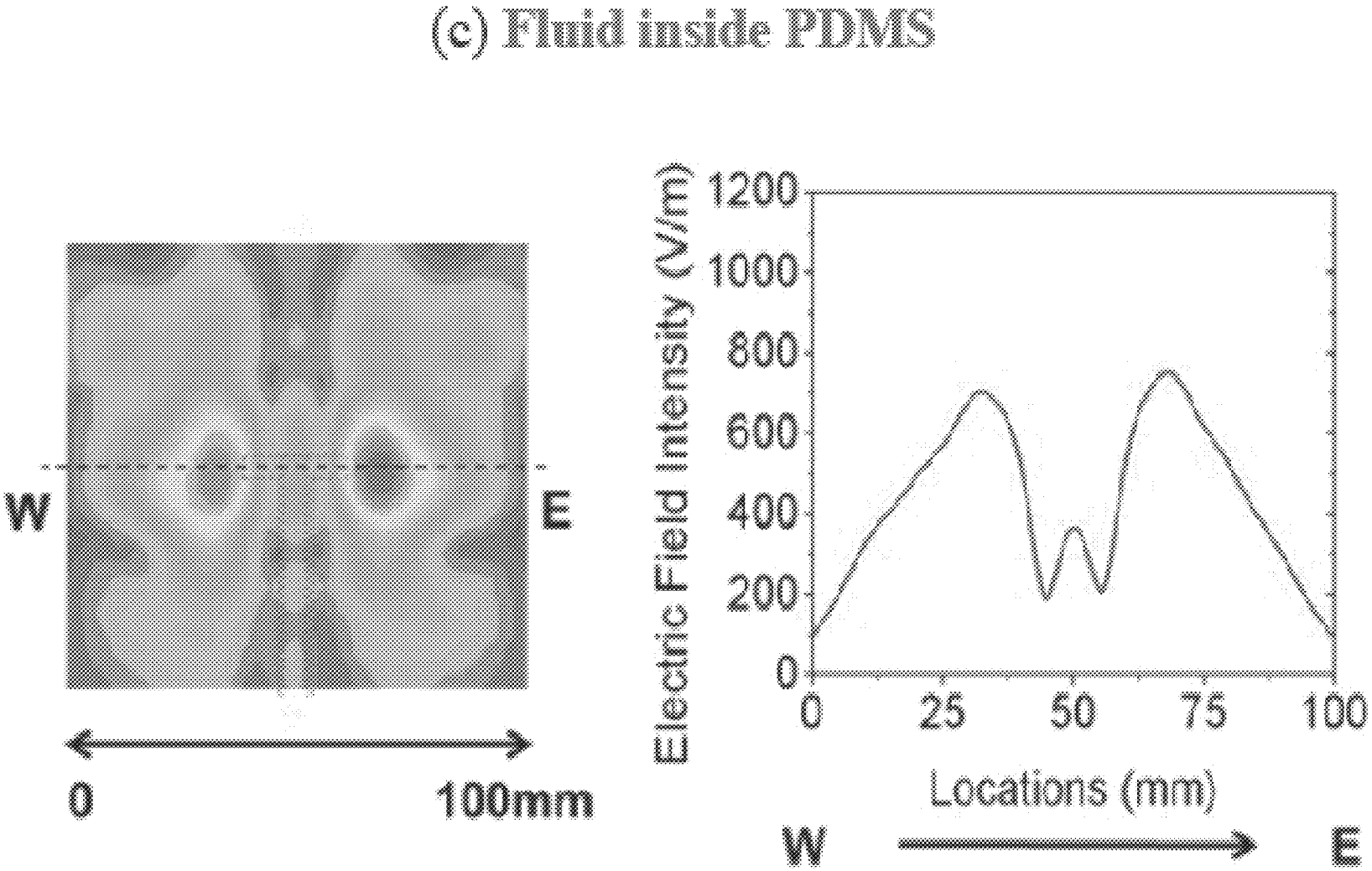
FIG. 2C is a diagram illustrating an example near-field distribution at 11.2 Gigahertz (GHz) above the FSS (left) and electric field intensity along West-East (right), in an example FPC antenna system having fluid inside the PDMS, in accordance with one or more aspects of the present disclosure.

Designs are modeled and simulated using full wave modeling tools (ANSYS HFSS). The near-field distribution of the FPC systems at 11.2 GHz are shown in FIGS. 2A-2C. A reference plane is located at 5 mm above FSS 108 and the near-field is observed at the reference plane. Three systems are considered in these figures: FIG. 2A (no PDMS housing 110); FIG. 2B (air inside PDMS housing 110); and FIG. 2C (fluid inside PDMS housing 110). For the case where there is no PDMS (FIG. 2A), an oval shape of field is formed around the slot. The field spreads out and is focused on overall length of the slot antenna. The peak intensity is 971 V/m and the percentage of distance along the West-East (W-E) line (P) that exceeds half of peak intensity is 45.5%.

When air is inside PDMS 110 (FIG. 2B), most of the field is formed strongly around the center of the system and the field is much more tapered compared to no PDMS case. The peak intensity increases by 66 V/m to 1037 V/m and the percentage of distance along the W-E line (P) decreases to 17.5%. This beam narrowing or focusing is due to the dielectric focusing effect that results in near-field beam-focusing. When filled with a fluid inside PDMS (FIG. 2C), the beam splits along the W-E line and is spaced around the edge of the IA-slot antenna 106. The peak intensity of split beams is 753 V/m and the null is 189 V/m. As deionized water 112 absorbs energy from the source due to its resistive nature, the near-field is significantly suppressed in the region above slot antenna 106 and feedline, thus leading to near-field beam-splitting. These beams can be considered 1 by 2 array antenna. Slot antenna 106 may be fed by a coplanar waveguide (CPW) feedline. In some alternate examples, a patch antenna may be used instead of a slot antenna. In these examples, the patch antenna may be fed by a microstrip line. In certain cases, the patch antenna may be a narrow-band unidirectional antenna.

Figure 3B:
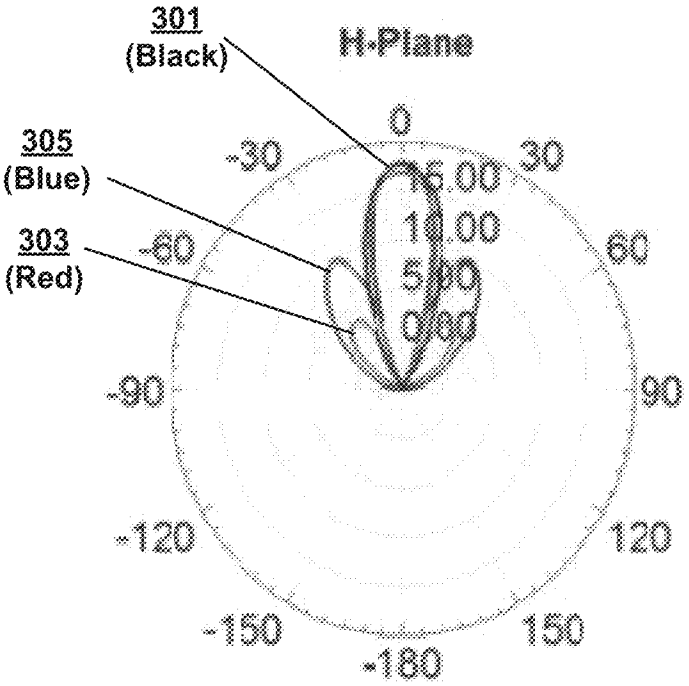
FIG. 3B is a diagram illustrating example simulated far-field radiation patterns at 11.2 GHz in the H-Plane of an example FPC antenna system, with no PDMS illustrated in first pattern 301 (black), air inside PDMS illustrated in second pattern 303 (red), and fluid inside PDMS illustrated in third pattern 305 (blue), in accordance with one or more aspects of the present disclosure.
Figure 3A:
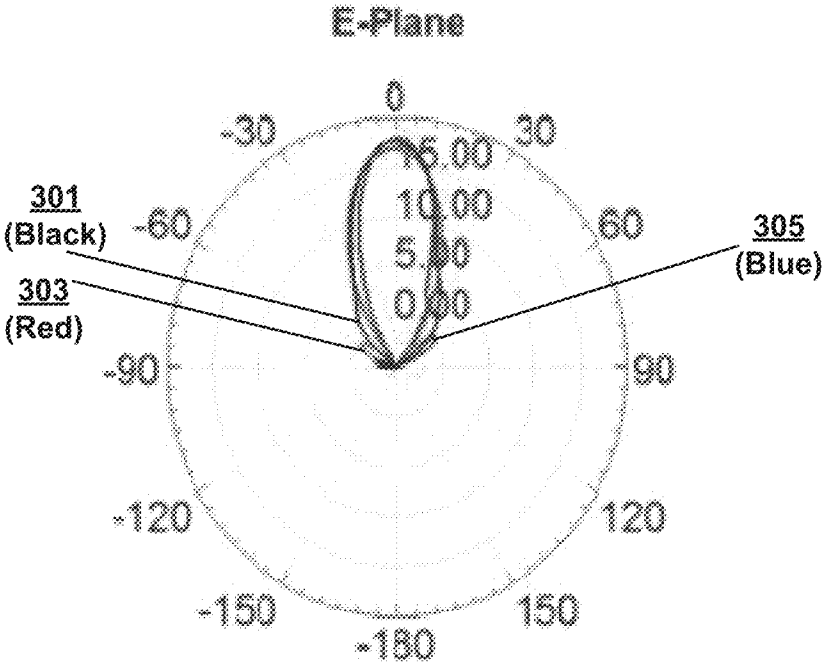
FIG. 3A is a diagram illustrating example simulated far-field radiation patterns at 11.2 GHz in the E-Plane of an example FPC antenna system, with no PDMS illustrated in a first pattern 301 (black), air inside PDMS illustrated in a second pattern 303 (red), and fluid inside PDMS illustrated in a third pattern 305 (blue), in accordance with one or more aspects of the present disclosure.
Figure 4A:
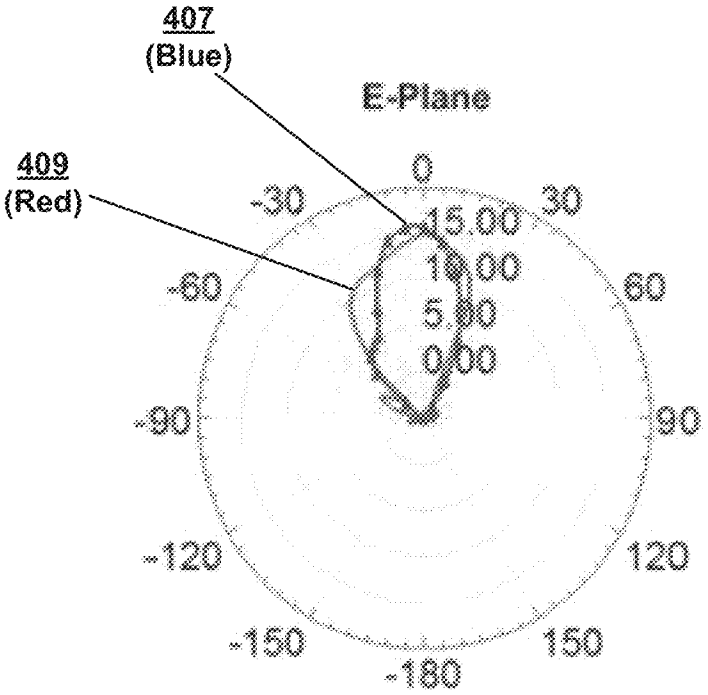
FIG. 4A is a diagram illustrating example measured far-field radiation patterns at 10.91 GHz in the E-Plane of an example FPC antenna system, with air inside the PDMS illustrated in a first pattern 409 (red), and fluid inside the PDMS illustrated in a second pattern 407 (blue), in accordance with one or more aspects of the present disclosure.
Figure 4B:
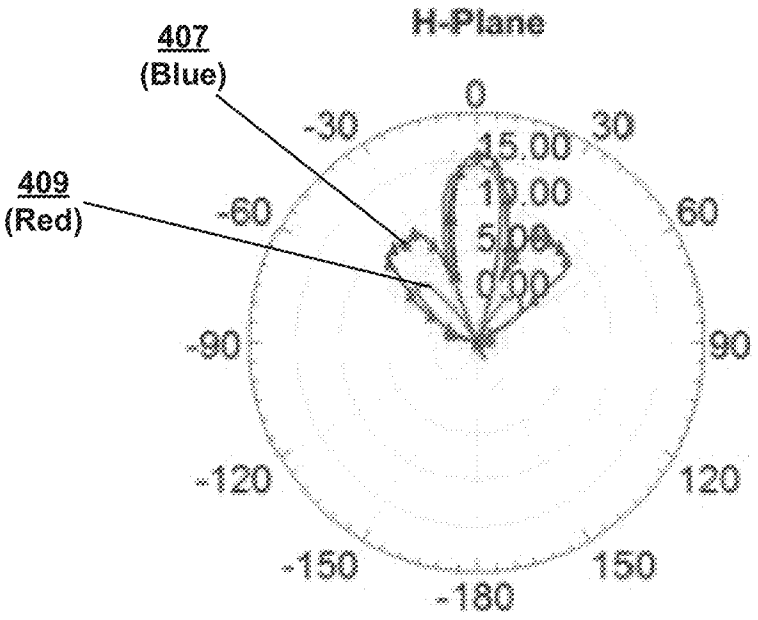
FIG. 4B is a diagram illustrating example measured far-field radiation patterns at 10.91 GHz in the H-Plane of an example FPC antenna system, with air inside the PDMS illustrated in first pattern 409 (red), and fluid inside the PDMS illustrated in second pattern 407 (blue), in accordance with one or more aspects of the present disclosure.

FIGS. 3-4 show the simulated and measured far-field radiation patterns for each of various FPC systems, respectively (e.g., system with no PDMS 110, system with air inside PDMS 110, and/or system with fluid inside PDMS 110). FIG. 3A is a diagram illustrating example simulated far-field radiation E-plane patterns at 11.2 GHz in an FPC antenna system having no PDMS 110 illustrated in a first pattern 301 (black), air inside PDMS 110 illustrated in a second pattern 303 (red), or fluid inside PDMS 110 illustrated in a third pattern 305 (blue). FIG. 3B is a diagram illustrating example simulated far-field radiation H-plane patterns at 11.2 GHz in an FPC antenna system having no PDMS 110 illustrated in first pattern 301 (black), air inside PDMS 110 illustrated in second pattern 303 (red), and fluid inside PDMS 110 illustrated in third pattern 305 (blue). FIG. 4A is a diagram illustrating example measured far-field radiation E-plane patterns at 10.91 GHz for the case where air is inside PDMS 110 illustrated in a first pattern 409 (red), or fluid is inside PDMS 110 illustrated in a second pattern 407 (blue). FIG. 4B is a diagram illustrating example measured far-field radiation H-plane patterns at 10.91 GHz for the case where air is inside PDMS 110 illustrated in first pattern 409 (red), or fluid is inside PDMS 110 illustrated in second pattern 407 (blue).

The use of the 10 mm wide PDMS channel introduces side lobes in the H-plane cut. When the lossy deionized water is injected, it results in higher side lobe levels that result from the split beam separation increasing above 1λ as a result of the absorptive nature of the DI channel. In some cases, channel width and volume can impact the beam split separation, and smaller cavity widths to 8 mm may produce lower side lobes. Table 1 below confirms that the presence of the deionized water does not hinder the gain of the FPC system. The use of fluidic channel makes the near-field beam focusing or splitting and does not hinder the far-field performance.

TABLE 1

SIMULATED FAR-FIELD RADIATION PATTERN PEAK GAIN

| | Peak Gain (dBi) |
|---|---|
| No PDMS | 17.70 |
| Air | 16.93 |
| Fluid | 17.83 |

For a coplanar waveguide (CPW)-fed slot antenna, there is often a feedline effect on the radiation pattern, such as a feedline contribution to the far-field radiation pattern. However, the fluidic FPC antenna system described herein, including FSS 108 and fluidic channel housing 122, may, in use, mitigate the focusing effect of a CPW feedline through FSS 108 and reduce feedline radiation above FSS 108, such that coupling above FSS 108 is minimized and feedline far-field radiation is also reduced or negligible. Through the inclusion of fluidic channel housing 122 on an opposite side of FSS 108 with respect to horizontally shaped unit cells 120, the radiation through FSS 108 is suppressed, thereby alleviating the effects of the feedline behavior. This technique offers the advantage of mitigating the coupling and feedline interference effects in FPC architectures and other electronic elements used in antenna arrays and three-dimensional (3D) packaging designs (e.g., 3D high-density packaging). When used in antenna array applications, the FPC antenna system described herein may utilize an antenna as a single source, where the FPC system that includes fluidic channel housing 122 may implement beam splitting (e.g., using fluid such as deionized water inside PDMS 110) to create multiple modulated beams for use in the array. The FPC system is capable of performing such beam-splitting to create two or more modulated beams having configurable spacing (e.g., based upon the design parameters of the FPC system and fluidic channel housing 122).

Further described in this disclosure are two FSS designs with rectangular apertures: augmented and microfluidic FSS arrays. Each is designed, modeled, and tested for comparison in the FPC system, enabling simple but novel techniques to beam form that results in near-field beam-splitting in an FPC antenna system. The results, using fluids for FSS reconfiguration, are shown and the effects of a fluidic volume on an FSS-AH are compared to an augmented FSS design (FSS-1V) having a column of vertically oriented cells. The augmented FSS-1V design has 8 columns of horizontally oriented unit cells (27 unit cells in each column), with vertically oriented ones in the center on one surface. The vertically oriented unit cells are included in a vertical column. The vertical unit cells reflect energy from the source back into the cavity and contribute to beam-splitting. Vertically oriented unit cell units may have the same cell size and dimensions, and include, within the vertical column, 9 rows of vertically oriented cell units each having three adjacent cell units to achieve the same 10 mm column width of the design. Thus, by definition, one vertical column equals 9 by 3 vertical elements. The augmented FSS-1V and microfluidic FSS arrays are shown with a cavity-backed slot antenna in the FPC and will be compared for near- and far-field performance.

The augmented FSS-1V design uses a slot antenna and is capable of splitting a near-field beam in the FPC antenna system. This approach, however, may include modification of the uniform FSS design of horizontally oriented rectangular unit cells (FSS-AH) to include a column of vertically oriented unit cells. To obtain near-field beam-splitting without modifying the FSS-AH structure, a fluidic channel is introduced into the FPC system, as described above.

A coplanar waveguide (CPW)-fed slot antenna may be designed and employed as a single source. The FSS-AH design includes 9 by 27 rectangular unit cells. Each unit cell is 10 mm by 3 mm and has a rectangular aperture length of 8 mm and width of 0.5 mm. A rectangular aperture may be positioned (e.g., centered substantially in the middle) of a respective unit cell. Each column of cells in the FSS-AH design is approximately 10 mm wide.

Figure 5:
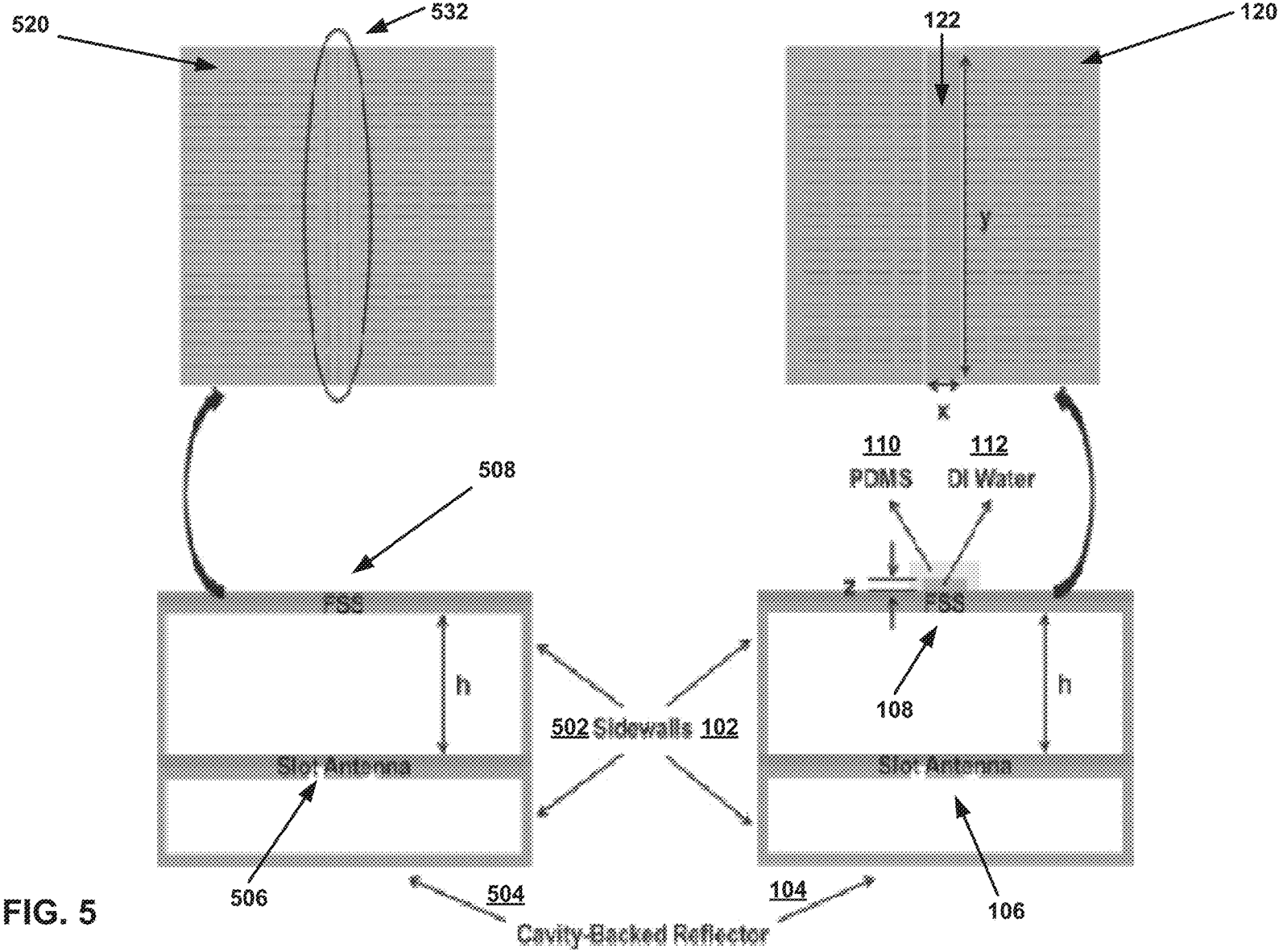
FIG. 5 is a diagram illustrating an example structure of a first cavity-backed FPC antenna system with an augmented FSS (FSS-1V, left) and an example structure of a second cavity-backed FPC antenna system with a microfluidic FSS with horizontally oriented cells (FSS-AH with fluidic channel, right), in accordance with one or more aspects of the present disclosure.

FIG. 5 shows both the augmented FSS-1V design (left side) and FSS-AH with microfluidic channel design (right side), where both the FSS-1V and FSS-AH with microfluidic FSS array designs are part of respective cavity backed FPC antenna systems. These two systems are shown side-by-side in FIG. 5 for purposes of comparison. The source for each of the two systems shown in FIG. 5 is a 1λ-slot dipole antenna (i.e., slot antenna 106 for the FSS-AH with microfluidic FSS array design, slot antenna 506 for the FSS-1V design), inductively fed by a 50Ω coplanar waveguide (CPW) feedline.

The FSS-1V design, shown on the left side of FIG. 5, provides a cavity-backed reflector 504, slot antenna 506, sidewalls 502, FSS 508, eight columns of horizontally oriented unit cells 520, and one column of vertically oriented cells 532. Each column of horizontally oriented unit cells includes nine individual cells. The column of vertically oriented cells includes nine rows of cells, where each row includes three individual cells.

The FSS-AH with microfluidic FSS array design, shown on the right side of FIG. 5, includes the structure illustrated in FIGS. 1A-1B. The microfluidic FSS array (FSS-AH with fluidic channel 122) has all horizontally oriented unit cells 120 on one surface and fluidic channel 122 is localized along the center on the other. The fluidic housing for channel 122 is made of PDMS 110 and attached to the back of FSS 108. Deionized water 112 is selected as a fluid in this example because it has a dielectric constant ($\varepsilon_r$=81) and conductivity ($\sigma$=5.5×10$^{-6}$ S/m). It leads to high absorption of energy from the source thus fluidic channel 122 behaves as a highly reflective surface which is equivalent to the vertical unit cells in the FSS-1V. Two fluidic volumes (x×y×z) are used in this study: (i) 8×87×1 mm$^3$ (narrow channel); or (ii) 10×87×1 mm$^3$ (wide channel). Deionized water 112 is injected into PDMS channel. To conserve energy, metallic sidewalls and reflectors enclose the FPC systems. The cavity height (h) is 10.81 mm. All systems are printed on RT/Duroid5880 ($\varepsilon_r$=2.2, substrate height=1.57 mm).

Figure 6A:
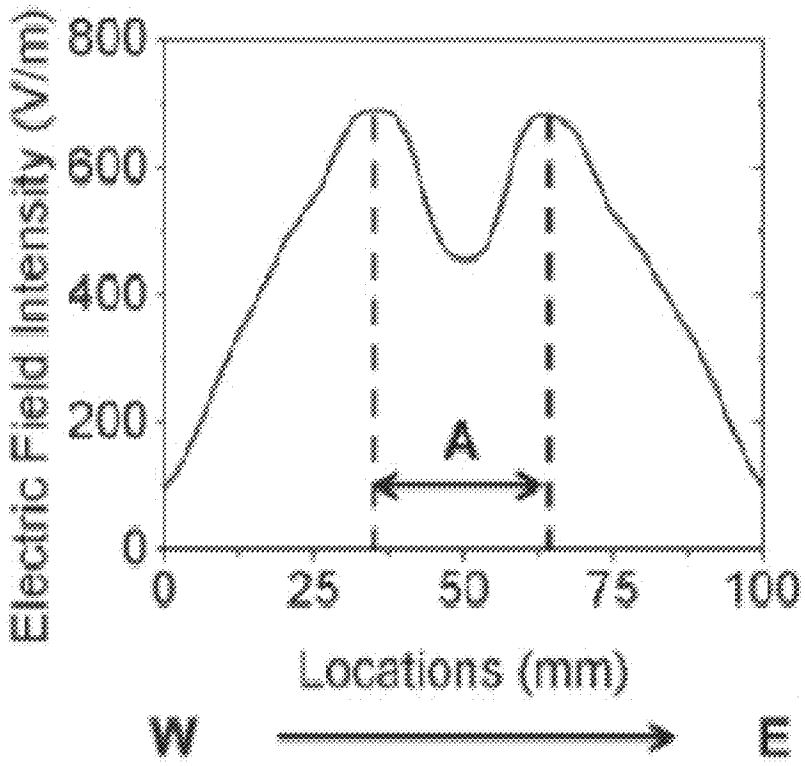
FIG. 6A is a diagram illustrating an example near-field distribution at 11.2 GHz above the FSS (left) and electric field intensity along the West-East line (right), in an example FPC antenna system having an augmented FSS-1V structure, in accordance with one or more aspects of the present disclosure.
Figure 6A:
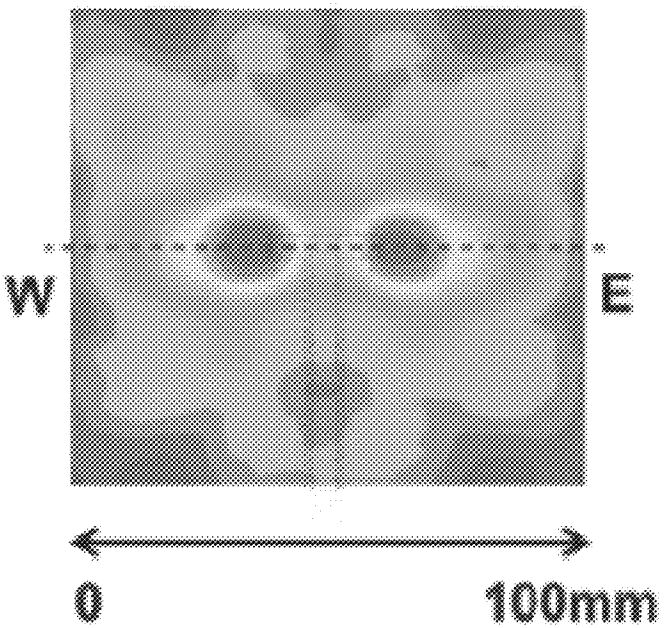
Figure 6B:
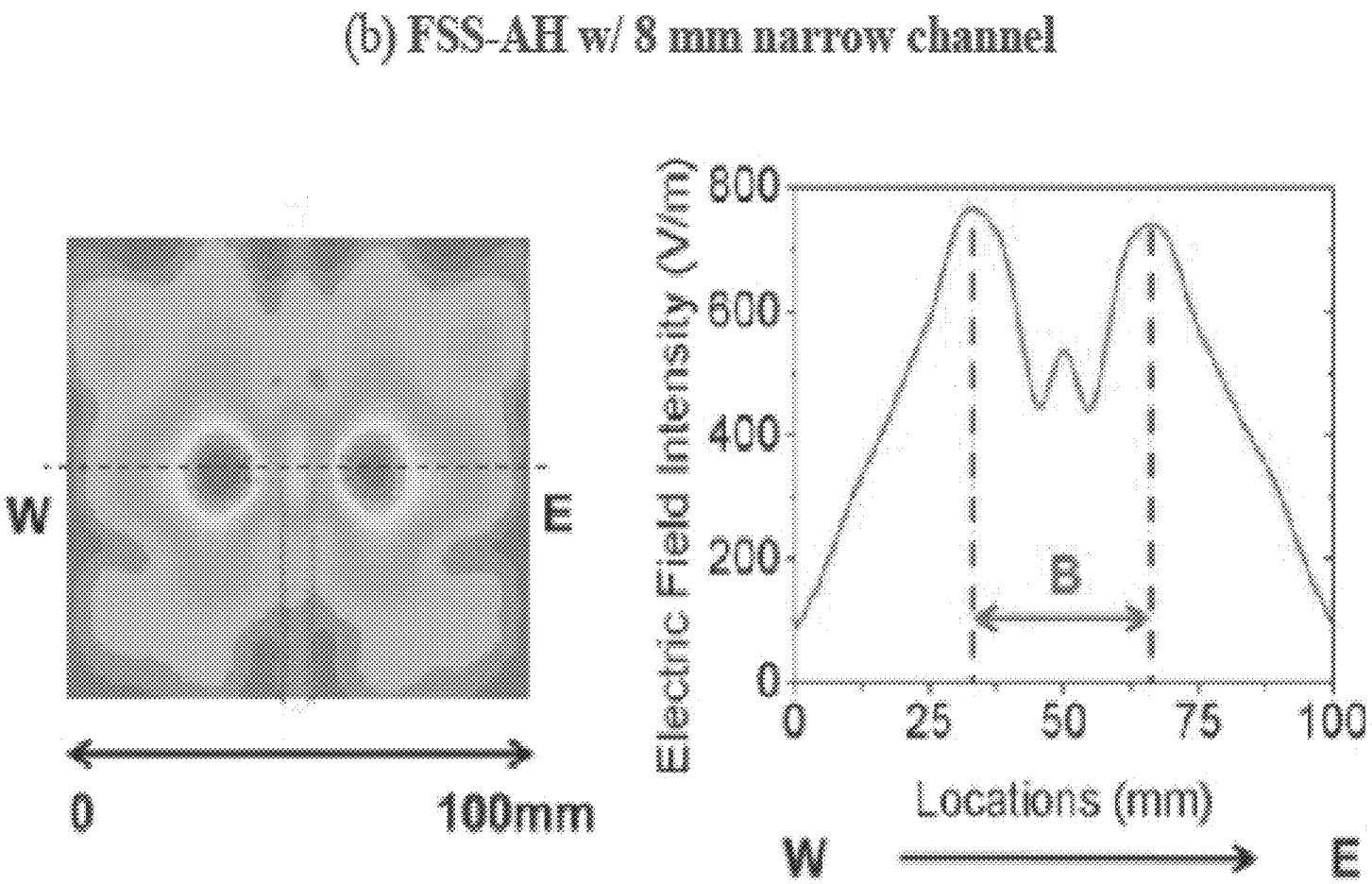
FIG. 6B is a diagram illustrating an example near-field distribution at 11.2 GHz above the FSS (left) and electric field intensity along the West-East line (right), in an example FPC antenna system having an FSS-AH structure with a fluidic 8 mm narrow channel, in accordance with one or more aspects of the present disclosure.
Figure 6C:
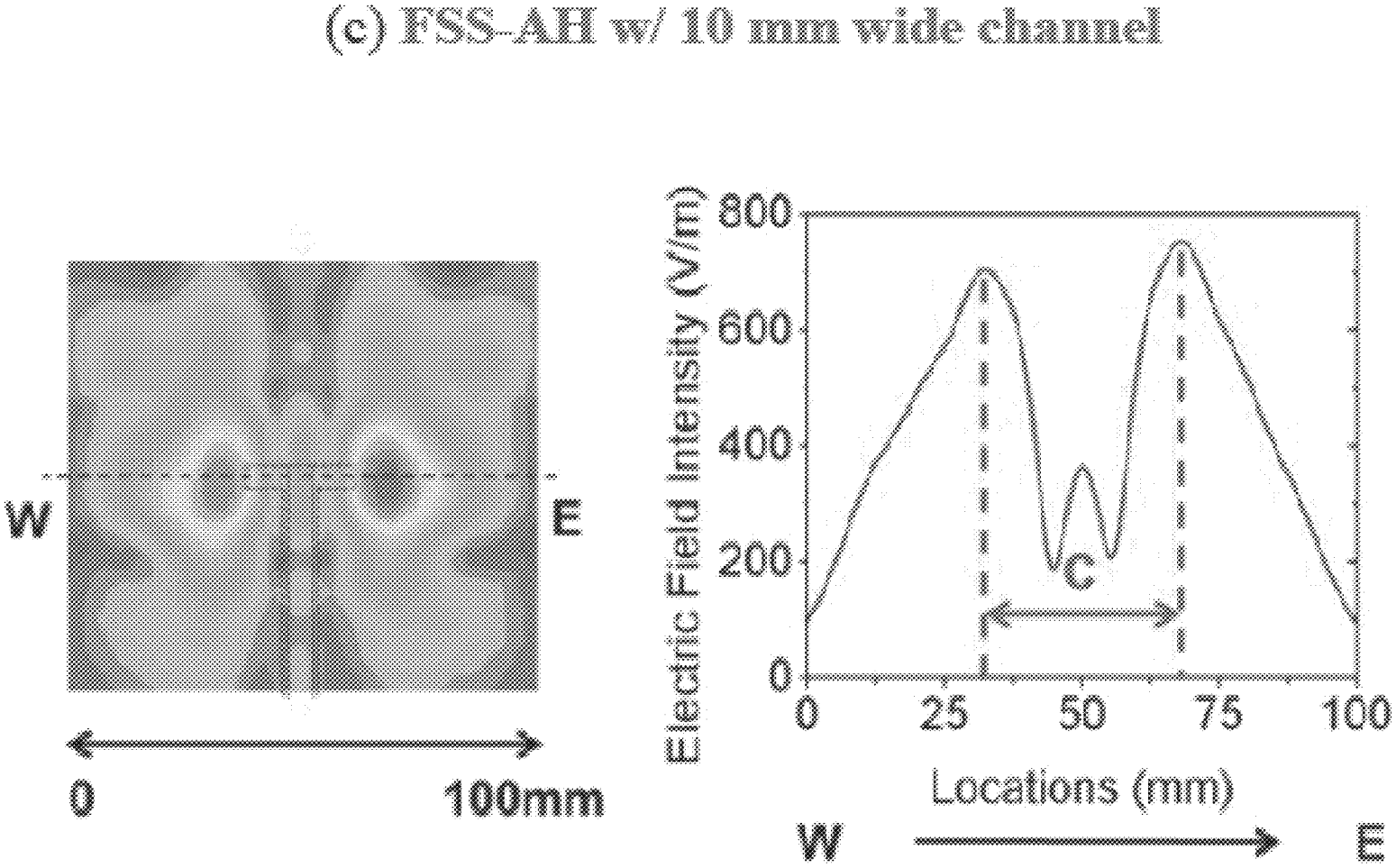
FIG. 6C is a diagram illustrating an example near-field distribution at 11.2 GHz above the FSS (left) and electric field intensity along the West-East line (right), in an example FPC antenna system having an FSS-AH structure with a fluidic 10 mm wide channel, in accordance with one or more aspects of the present disclosure.

FIGS. 6A-6C shows near-field distribution of each FPC system (FSS-1V and FSS-AH with fluidic channel) at 11.2 GHz. The field is observed at a reference plane located at 5 mm above the FSS in each system. The near-field beam is split along the W-E line for all cases due to highly reflective surface (vertically oriented unit cells in FSS-1V, or fluidic channel in the FSS-AH design). For the FSS-1V, the centered vertical slots provide internal reflections within the cavity that limits leakage outside FSS. In FIG. 6A, the spacing between split beams (A) is 29.75 mm and the peak intensity is 691 V/m. The null in this design reduces to 456 V/m. The deionized fluidic channel is used to synthesize the behavior of the 1V region in a reconfigurable manner. For the FSS-AH with a 8 mm narrow channel (FIG. 6B), the near-field beam spacing (B) increases to 33.25 mm and the peak intensity increases to 767 V/m. Whereas, for the FSS-AH with a 10 mm wide channel (FIG. 6C), the spacing (C) increases up to 35.75 mm and the peak intensity slightly decreases to 753 V/m. The FSS-1V and the FSS-AH with wide channel have similar dimensions, however the FSS-AH with narrow channel produces more similar results to the FSS-1V design. The split beams in the wide channel design may occur because the deionized water blocks more energy leakage due to its absorptive nature.

Figure 7B:
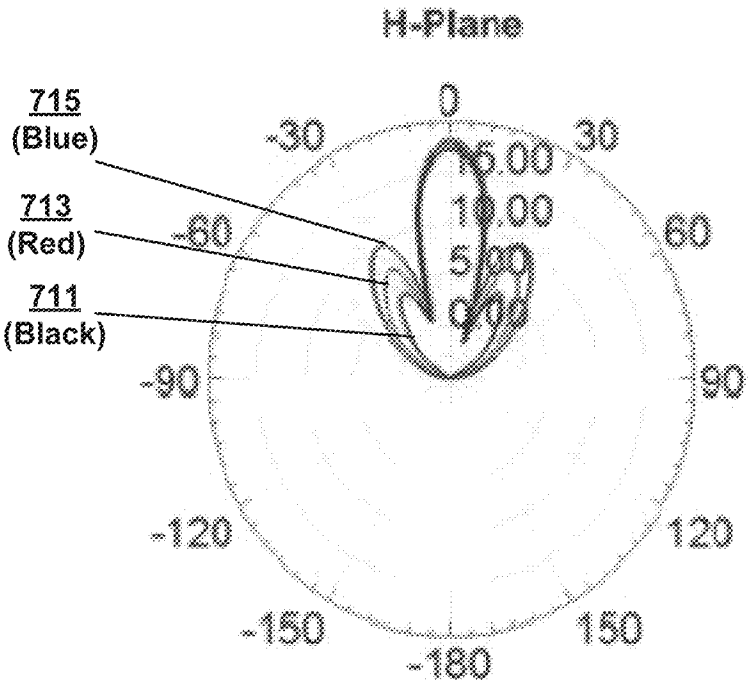
FIG. 7B is a diagram illustrating simulated far-field radiation patterns at 11.2 GHz in the H-Plane of an example FPC antenna system, where the example FSS-1V is associated with first pattern 711 (black), the example FSS-AH with 8 mm narrow channel is associated with second pattern 713 (red), and the example FSS-AH with 10 mm wide channel is associated with third pattern 715 (blue), in accordance with one or more aspects of the present disclosure.
Figure 7A:
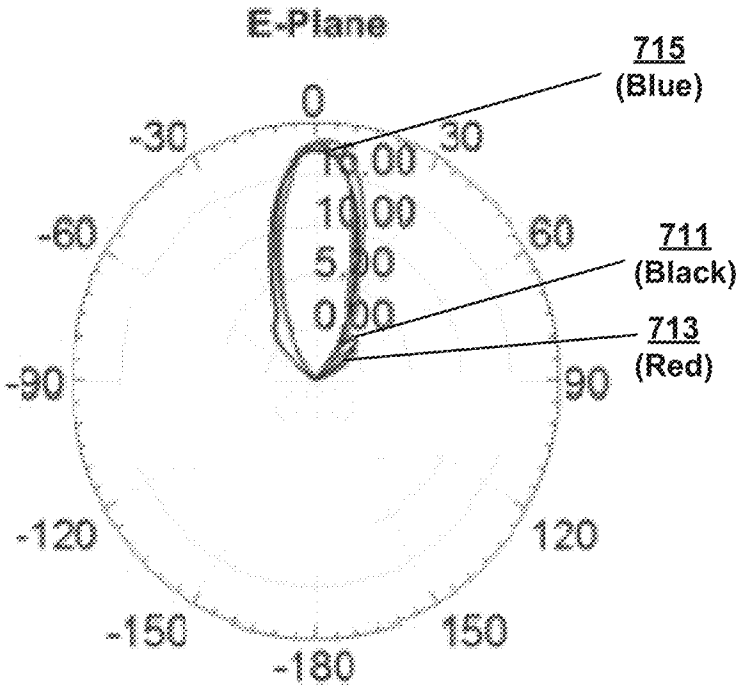
FIG. 7A is a diagram illustrating simulated far-field radiation patterns at 11.2 GHz in the E-Plane of an example FPC antenna system, where the example FSS-1V is associated with a first pattern 711 (black), the example FSS-AH with 8 mm narrow channel is associated with a second pattern 713 (red), and the example FSS-AH with 10 mm wide channel is associated with a third pattern 715 (blue), in accordance with one or more aspects of the present disclosure.
Figure 8B:
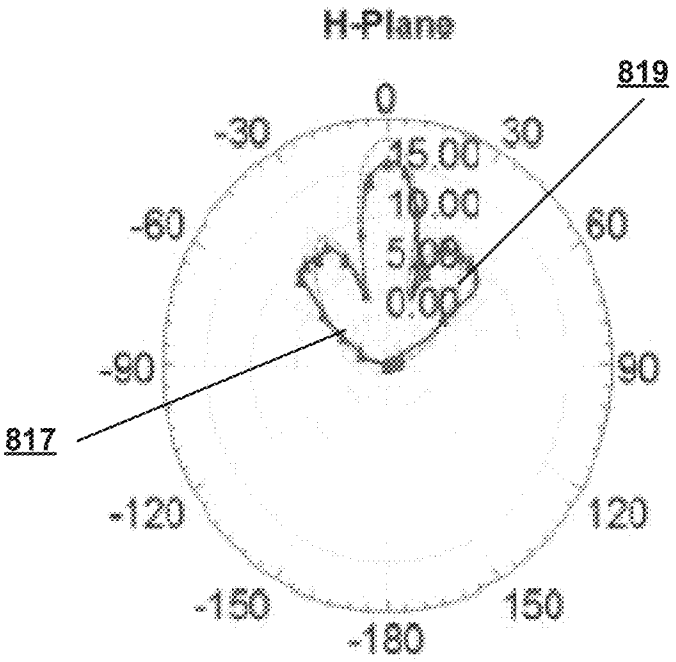
FIG. 8B is a diagram illustrating simulated (dashed 819) and measured (solid 817) far-field radiation patterns for an example FSS-AH structure with a fluidic 10 mm wide channel at 10.91 GHz in the H-Plane of an example FPC antenna system, in accordance with one or more aspects of the present disclosure.
Figure 8A:
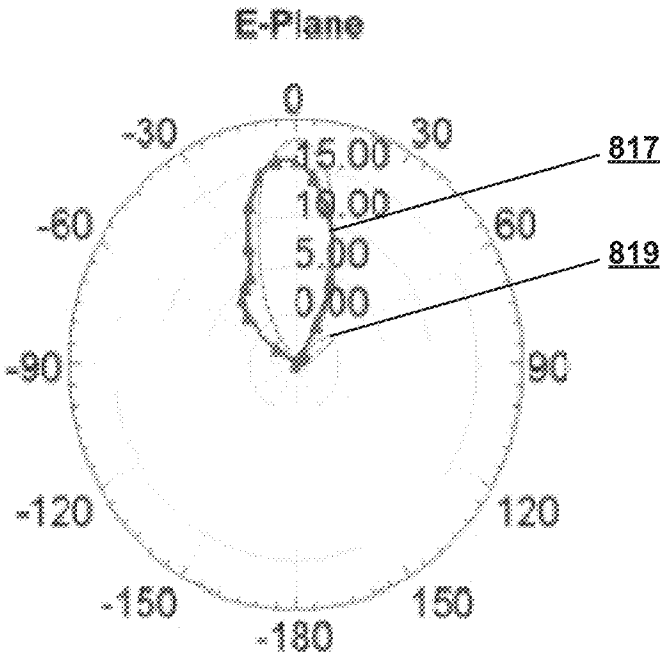
FIG. 8A is a diagram illustrating simulated (dashed 819) and measured (solid 817) far-field radiation patterns for an example FSS-AH structure with a fluidic 10 mm wide channel at 10.91 GHz in the E-Plane of an example FPC antenna system, in accordance with one or more aspects of the present disclosure.

FIGS. 7A-7B illustrates far-field radiation patterns at 11.2 GHz for each FPC design (FSS-1V and FSS-AH with fluidic channel), where the example FSS-1V is associated with a first pattern 711 (black), the example FSS-AH with 8 mm narrow channel is associated with a second pattern 713 (red), and the example FSS-AH with 10 mm wide channel is associated with a third pattern 715 (blue). FIG. 7A shows the E-plane patterns for both designs, and FIG. 7B shows the H-plane patterns for both designs. The E-plane patterns are similar but the H-plane have side lobes due to split beams along the W-E line corresponding to H-plane cut. For the FSS-1V, the gain is 17.21 dBi and side lobe is 4.3 dB. For the FSS-AH with narrow channel, the gain increases approximately by 1 dB (~24%) to 18.16 dBi but side lobe also increases to 7.08 dB. For the FSS-AH with wide channel, the gain slightly drops to 17.83 dBi but side lobe increases to 9.83 dB. FIGS. 8A-8B shows the simulated (dashed 819) and measured (solid 817) patterns for FSS-AH with wide channel fluidic design (E-plane shown in FIG. 8A, H-plane shown in FIG. 8B). Simulation and measurement results have good agreement.

The microfluidic FPC antenna system is configured to split and control beam in the near-field region. Fluidic channel width effects indicate that channel width and volume can impact the beam split separation, as well as that smaller cavity widths to 8 mm may produce much lower side lobes. The design of the augmented FSS-1V and FSS-AH 8 mm narrow fluidic FSS allow the split beams to be located at the edge of the slot antenna and produce similar near- and far-field behavior.

As outlined earlier, the present disclosure further describes one or more techniques for providing free space vertical interconnects using an FPC antenna system in the near field for various applications (e.g., 60 GHz applications). In some examples, the antenna system includes a patch antenna transmitter that communicates with a patch antenna receiver via an FSS. In some examples, the antenna system includes a slot antenna transmitter that communicates with a patch antenna receiver via an FSS. In some examples, one or more horn antennas may also be used in the system (e.g., as the transmitter), and/or any other form of radiating element that outputs beams that are orthogonal to a surface of the FSS. Vertical interconnects are being used extensively with aggressive scaling of device geometries and in three dimensional (3D) integrated systems (e.g., stacked backplanes in servers, substrate integrated packaging, 3D integrated circuits, silicon integrated circuits for digital and/or analog design) to obtain more performance from a limited area. In some cases, at the system level, wireless interconnects can be used to communicate between multi-chip systems. The inter-chip interconnects may enable chip-to-chip communication and introduce an energy efficient, high bandwidth unified communication architecture into homogeneous, heterogeneous and memory intensive multi-chip systems. One or more techniques disclosed herein describe a novel free space interconnect design that is based on an FPC antenna (FPCA) design to couple its near field focusing beam to a nearby receive antenna through a cavity. The design may, in various cases, provide a low loss solution to vertical interconnects that enhance signal transmission and reduce signal degradation and bandwidth limitation. The FPCA system may couple its near field focusing beam to a nearby receive antenna through a cavity, where the FPCA may be the transmitting antenna with a FSS.

In one or more examples, the design and simulation of a near-field coupled patch to an FPCA system is described herein. It includes an FPCA transmit system and FPCA plus patch bi-directional system, whose separation distance is obtained from parameterization with the receiving antenna. The end result is a vertical interconnect. The design results may be compared to measured losses of a planar through line and vertically connected through line based on a via design approach.

The FSS aperture in FPC antennas produce a unique near-field response that focuses the source antennas energy near the surface of the system. This energy, if harnessed properly, can be used to as a source in near-field applications. Certain prior designs have shown non-symmetric field strengths and large phase variations across the aperture in simulations and measurements, which have limited the useful applicability.

In the present disclosure, a new design is presented that produces, in various cases, a uniform near-field beam. Various examples of the design provide symmetrical near-field intensity and a nearly flat phase response. In various examples, the antenna system uses two patch antennas, one as the source and the other as the receiver, with an FSS design (e.g., square FSS design) placed over the source antenna. In some examples, a slot antenna may be used as the source, and a patch antenna may be used as the receiver. In some examples, one or more horn antennas may also be used in the system (e.g., as the transmitter), and/or any other form of radiating element that outputs beams that are orthogonal to a surface of the FSS.

Figure 10:
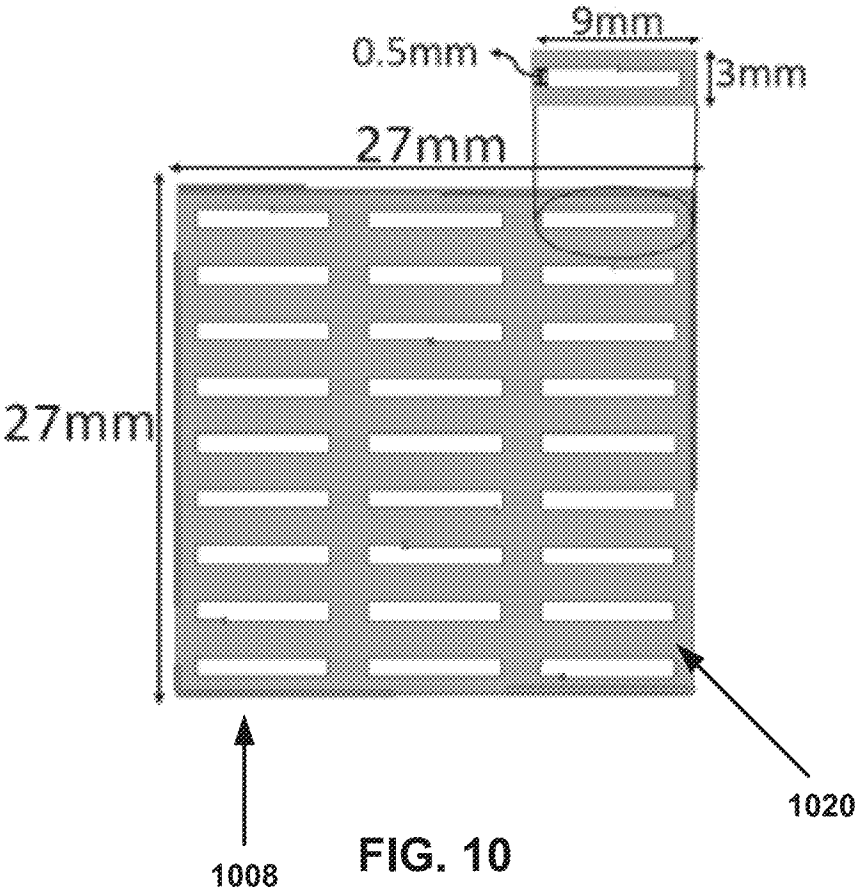
FIG. 10 is a diagram illustrating an example structure of an FSS, in accordance with one or more aspects of the present disclosure.
Figure 9:
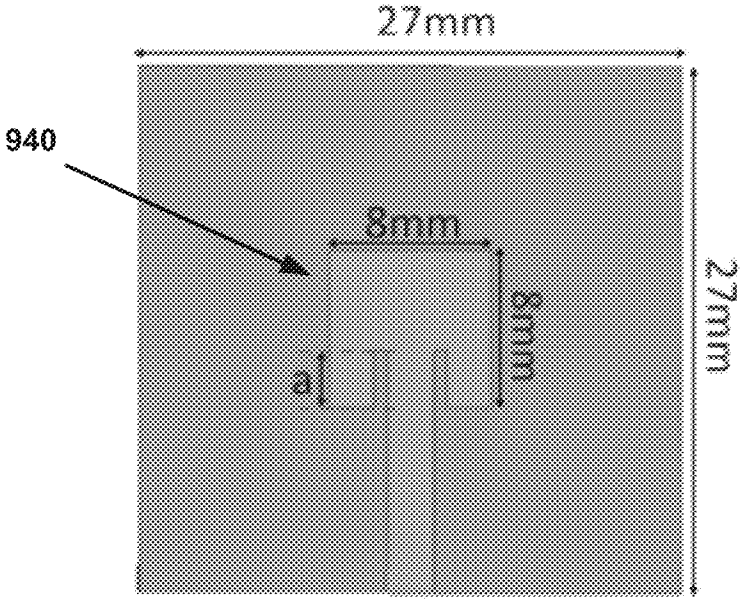
FIG. 9 is a diagram illustrating an example structure of a patch antenna, where the value of 'a' is 2.96 mm for 50 Ohm matching, and where the gap dimension for each illustrated inset feed/slot is 0.67 mm, in accordance with one or more aspects of the present disclosure.

In FIGS. 9-10, the design of patch antenna 940 and the FSS is displayed. FIG. 9 is a diagram illustrating an example structure of a patch antenna 940, where the value of 'a' is 2.96 mm for 50 Ohm matching, where the gap dimension for each illustrated inset feed/slot is 0.67 mm, and where other dimensions are shown as indicated, in accordance with one or more aspects of the present disclosure. FIG. 10 is a diagram illustrating an example structure of an FSS 1008, with dimensions shown as indicated, in accordance with one or more aspects of the present disclosure. In the example of FIG. 10, FSS 1008 includes horizontally oriented unit cells 1020. Cells 1020 include three columns, where each column includes nine individual horizontally oriented unit cells.

Figure 11A:
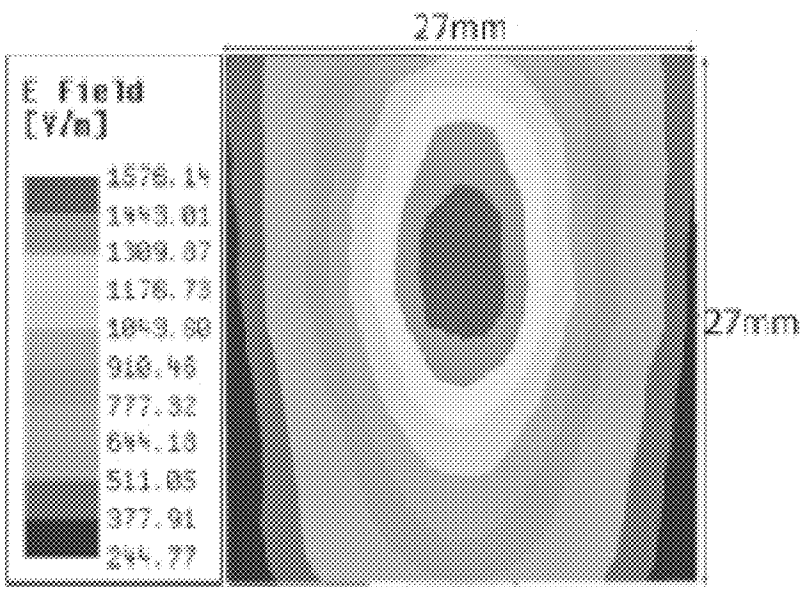
FIGS. 11A-11B are diagrams illustrating example electric field (E-field) magnitude at 5 mm above the FSS illustrated in FIG. 10, which shows the beam forming nature of the FSS, and also an example E-field at 5 mm above the antenna illustrated in FIG. 9 without an FSS, in accordance with one or more aspects of the present disclosure.
Figure 11B:
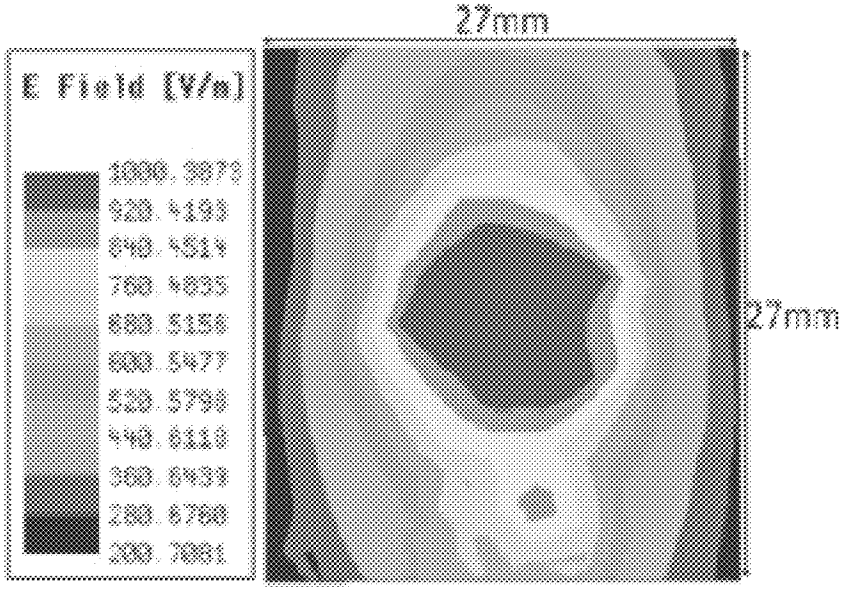

FIGS. 11A-11B are diagrams illustrating example electric field (E-field) magnitude at 5 mm above the FSS illustrated in FIG. 10, which shows the beam forming nature of the FSS, and also an example E-field at 5 mm above the antenna illustrated in FIG. 9 without an FSS, in accordance with one or more aspects of the present disclosure. The near field beam is symmetrical in intensity as shown in FIG. 11A. When the FSS is removed, FIG. 11B shows the high-frequency structure simulator (HFSS) E-field magnitude at a distance of 5 mm above the antenna. Hence, the FSS causes the electric field intensity to increase and the beam to become more concentrated. The near-field beam focusing property of the FSS is a feature of the described vertical interconnect.

In non-limiting examples, the FPCA plus receiver patch antenna system was developed as follows: all layers use Rogers Duroid 5880 with $\varepsilon_r$ of 2.2. The substrate height for aperture antennas and FSS is 0.75 mm and 0.5 mm, respectively.

Figure 12:
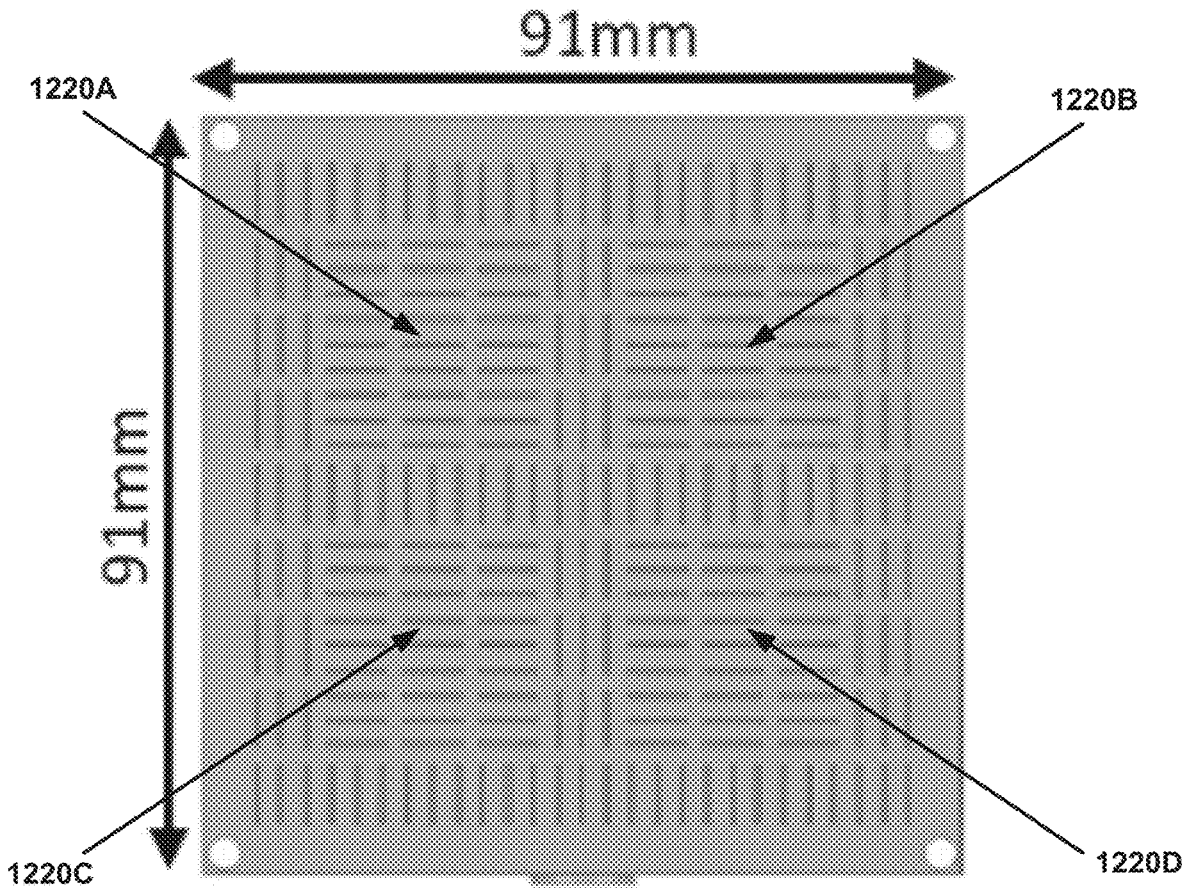
FIG. 12 is a diagram illustrating an example FSS structure that produces four beams, in accordance with one or more aspects of the present disclosure.
Figure 13:
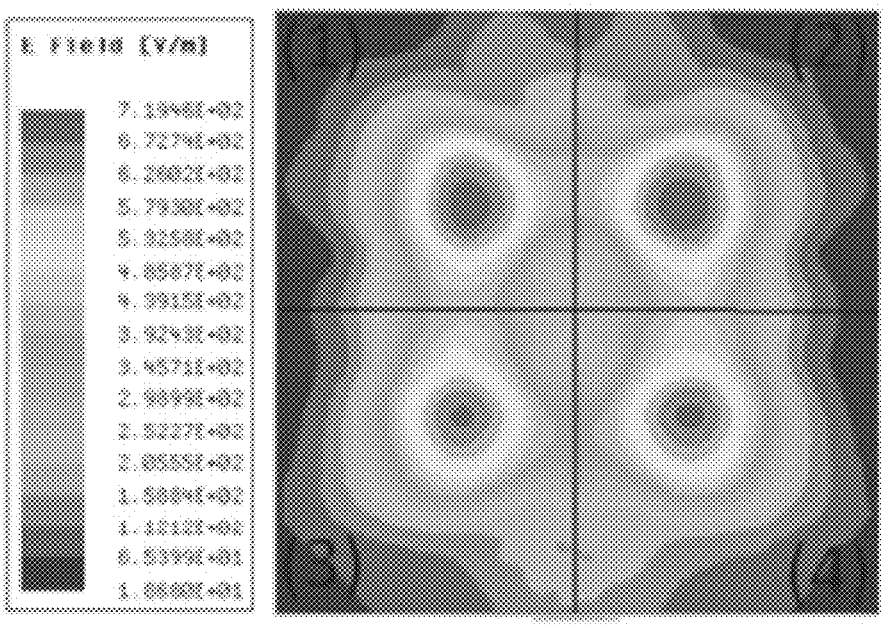
FIG. 13 is a diagram illustrating an example of generation of four beams observed at 5 mm above the FSS structure of FIG. 12, in accordance with one or more aspects of the present disclosure.

In non-limiting examples, the Fabry-Perot Cavity Antennas can be shown to produce multiple symmetrical beams that are symmetrical, according to one or more examples. FIG. 12 is a diagram illustrating an example FSS structure that produces four beams, with dimensions shown as indicated, in accordance with one or more aspects of the present disclosure. FIG. 13 is a diagram illustrating an example of generation of four beams observed at a plane 5 mm above the FSS structure of FIG. 12, in accordance with one or more aspects of the present disclosure. The example of FIGS. 12-13 illustrate beam splitting into four beams, although varied structures of the FSS may provide beam splitting into any number of beams. In various examples, the receive antenna may be enclosed in a metal cavity that creates shielding effect, such that the presence of other receivers will not necessarily affect the performance of one receiver. The beams in FIG. 13 can be thought of as having been divided into four sections. In some examples, one receiver or receiving antenna may be included in the antenna system to receive individual beams for each respective section (e.g., four separate receive antennas).

Having vertical apertures in the FSS, such as shown in FIG. 12, may enable beam splitting. No radiation is typically observed in the absolute near field above these apertures, so it can be deduced that most radiation reflects back from these apertures. Horizontal apertures are responsible for sending the radiation out since the field lines generated by the transmit antenna align with the direction of these apertures, and hence reflection is not observed. In various cases, substantially uniform and/or symmetric near-field split beams (e.g., four beams in the example of FIGS. 12-13) are provided above the FSS, with each of the split beams providing a substantially symmetrical near-field intensity and a nearly flat phase response.

As shown in the example of FIG. 12, the horizontally oriented unit cells are divided into four different groups 1220A-1220D, where each group is separate from another group of horizontally oriented unit cells by a number of vertically oriented unit cells. As also shown in FIG. 12, each group of horizontally oriented unit cells is surrounded by a number of vertically oriented unit cells. Each of the four groups 1220A-1220D includes three columns of horizontally oriented unit cells, and each of these three columns includes nine horizontally oriented unit cells. Each group of horizontally oriented unit cells may be similar to the group of cells shown in FIG. 10. This configuration of horizontally oriented unit cells and vertically oriented unit cells enables beam splitting of radiation that is emitted by the transmit antenna. In some cases, the receive antenna system that is positioned on one side of the FSS illustrated in FIG. 12 may include multiple different receive antennas or antenna elements. Each of these receive antennas may be configured to receive a portion of the radiation that passes through one or more of the horizontally oriented unit cells of the FSS from the transmitter.

For instance, a first receive antenna may be configured to receive a first portion of the radiation from the transmit antenna, illustrated in FIG. 13, which passes through first group 1220A of horizontally oriented unit cells of the FSS: a second receive antenna may be configured to receive a second portion of the radiation from the transmit antenna, illustrated in FIG. 13, which passes through second group 1220B of horizontally oriented unit cells of the FSS; a third receive antenna may be configured to receive a third portion of the radiation from the transmit antenna, illustrated in FIG. 13, which passes through third group 1220C of horizontally oriented unit cells of the FSS; and a fourth receive antenna may be configured to receive a fourth portion of the radiation from the transmit antenna, illustrated in FIG. 13, which passes through fourth group 1220D of horizontally oriented unit cells of the FSS. In other examples, only a single receive antenna may be utilized in receiving radiation that passes through the FSS illustrated in FIG. 12.

Figure 14A:
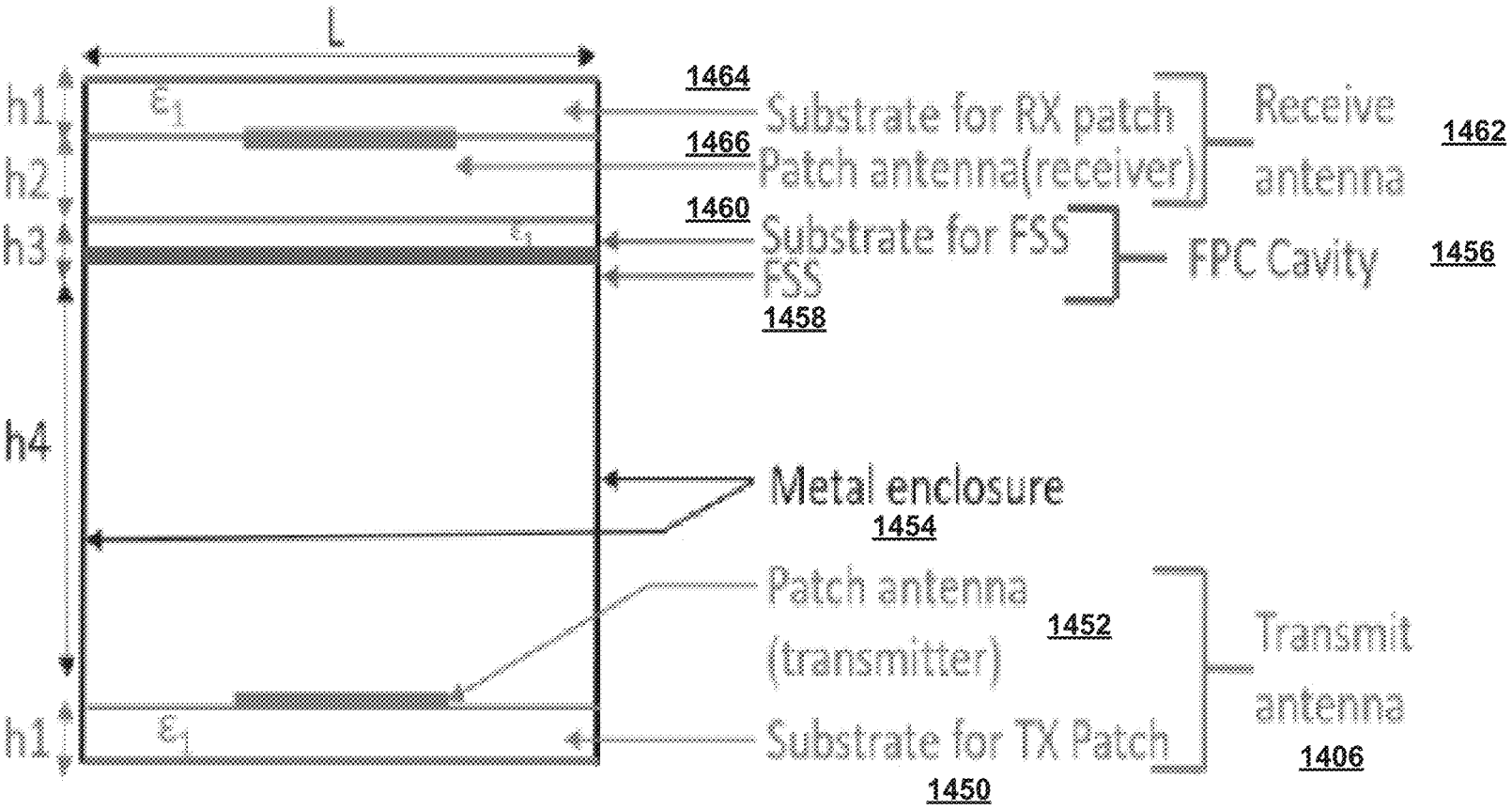
FIG. 14A is a diagram illustrating an example transmitter and receiver system for one near-field beam vertical interconnect that utilizes patch antennas, where first sections show both the patch antennas with their substrates, and where second sections show the FSS in between, in accordance with one or more aspects of the present disclosure.
Figure 14B:
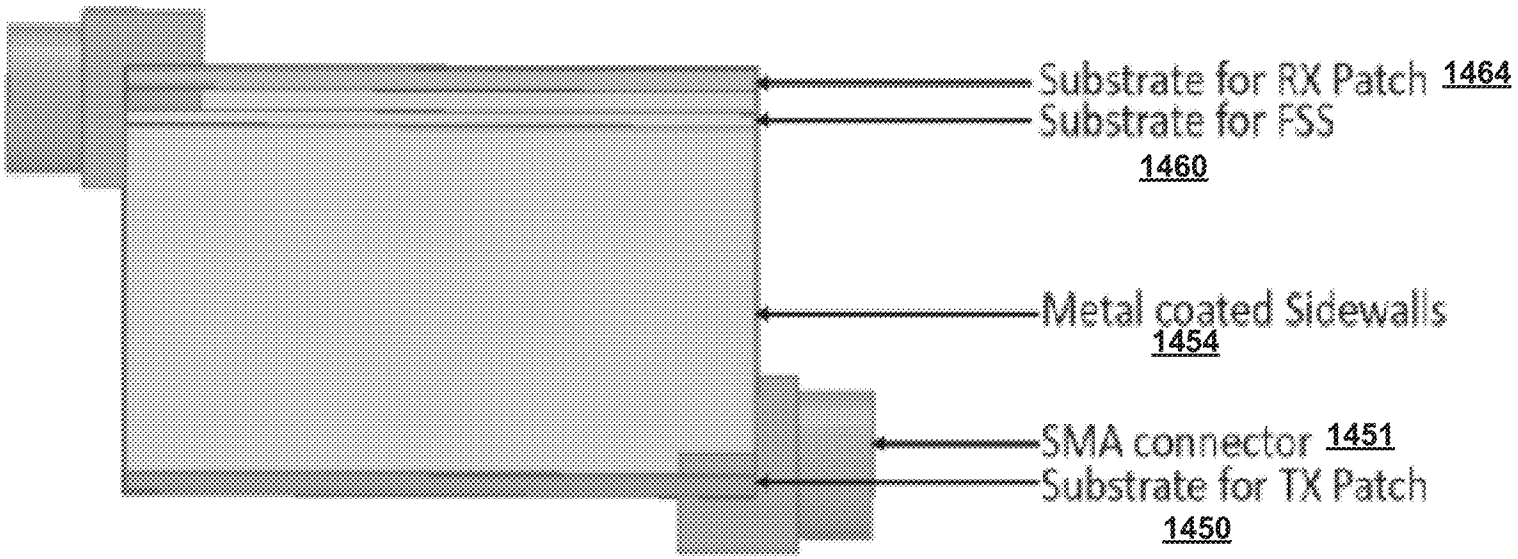
FIG. 14B is a diagram illustrating an example side view of the system shown in FIG. 14A that also shows connector positions, in accordance with one or more aspects of the present disclosure.

FIG. 14A is a diagram illustrating an example transmitter and receiver system for one near-field beam vertical interconnect that utilizes patch antennas, where first sections show both the patch antennas with their substrates, and where second sections show the FSS in between, in accordance with one or more aspects of the present disclosure. In the example of FIG. 14A, it is assumed that the receive antenna system receives one beam of radiation, such as that may be passed through the horizontally oriented unit cells of FSS shown in FIG. 10, or through one of the four groups of horizontally oriented unit cells 1220A, 1220B, 1220C, or 1220D shown in FIG. 12. FIG. 14B is a diagram illustrating an example side view of the system shown in FIG. 14A that also shows connector positions (e.g., SMA connector 1451), in accordance with one or more aspects of the present disclosure.

FIG. 14B illustrates the 3D placement of the vertical interconnect system that includes a transmit patch antenna, an FSS, and the receive patch antenna, which may, in certain examples, operate at 12 GHz. The entire assembly may be shielded with metal walls on the sides. Transmit antenna 1406 includes a substrate 1450 and a patch antenna (transmitter) 1452. Patch antenna 1452 is positioned between substrate 1450 and FSS 1458. FPC cavity 1456 includes FSS 1458 and substrate for FSS 1460. Receive antenna 1462 includes a substrate 1464 and a patch antenna (receiver) 1466. Patch antenna 1466 is positioned between FSS 1458 and substrate 1464. FSS 1458 is positioned between transmit antenna 1406 and receive antenna 1462. Metal enclosure 1454, which may comprise metal-coated sidewalls, may at least partially enclose transmit antenna 1406, FPC cavity 1456, and receive antenna 1462. Transmit antenna 1406 is configured to emit radiation. FSS 1458 has a first side and a second side opposite from the first side, where the first side of FSS 1458 faces transmit antenna 1406 and may have a structure such as described herein (e.g., a structure shown in FIG. 10 or FIG. 12). The first side of FSS 1458 is separated from the transmit antenna by a first defined distance, such as illustrated in FIG. 14A. At least a portion of the radiation emitted by transmit antenna 1406 passes through one or more horizontally oriented unit cells of FSS 1458, which includes one or more groups of cells that each includes multiple columns of one or more horizontally oriented unit cells. Receive antenna 1462 is configured to receive at least the portion of the radiation that passes through the horizontally oriented unit cells of FSS 1458.

In certain examples, the dimensions for the antenna system and the separation of the layers are described and laid out in Table 2 below:

TABLE 2

DESIGN SPECIFICATIONS

| Variable | Value |
|---|---|
| h1 | 0.75 mm |
| h2 | 0.80 mm |
| h3 | 0.50 mm |
| h4 | 12.50 mm |
| $\varepsilon_1$ | 2.20 mm |
| Patch Dimensions | 8 mm × 8 mm |
| Copper Thickness | 35 μm |
| Box Dimensions | Length - 27.0 mm<br>Width - 27.0 mm<br>Height - 20.6 mm |

Figure 15:
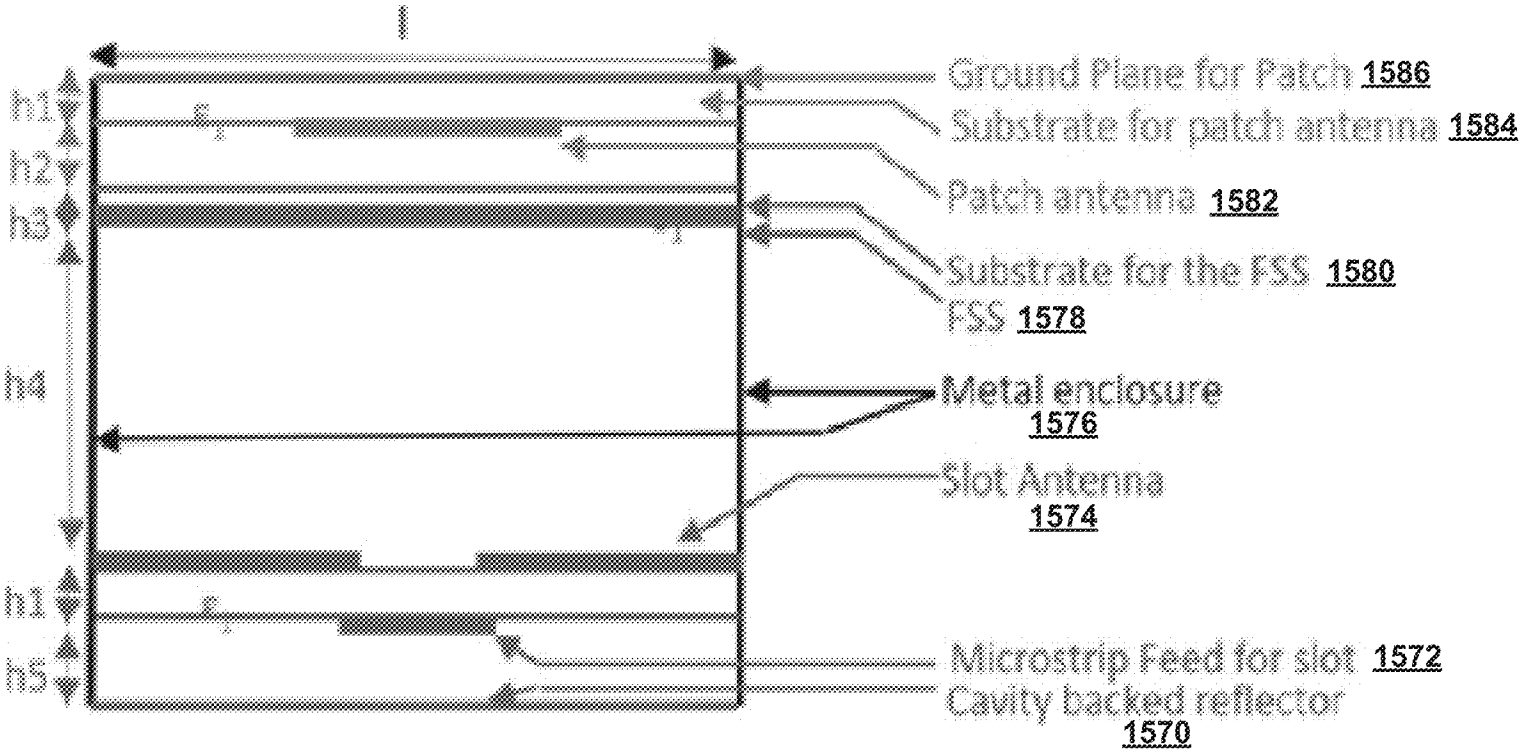
FIG. 15 is a diagram illustrating another example transmitter and receiver system for one beam that utilizes both slot and patch antennas, in accordance with one or more aspects of the present disclosure.

FIG. 15 is a diagram illustrating another example transmitter and receiver system for one beam that utilizes both slot and patch antennas, in accordance with one or more aspects of the present disclosure. (In certain other examples, one or more horn antennas may also be used in the system (e.g., as the transmitter), and/or any other form of radiating element that outputs beams that are orthogonal to a surface of the FSS.)

In the example of FIG. 15, a microstrip feed 1572 is positioned between cavity-backed reflector 1570 and slot antenna 1574. In the example of FIG. 15, slot antenna 1574 is the transmitter antenna. Metal enclosure 1576 is configured to at least partially enclose the components illustrated in FIG. 15.

The FPC cavity includes a substrate 1580 and FSS 1578. FSS 1578 is positioned between slot antenna 1574 and patch antenna 1582, where patch antenna 1582 is the receive antenna. The antenna system of FIG. 15 also shows a ground plane 1586 and a substrate 1584. Slot antenna 1574 is configured to emit radiation. FSS 1578 has a first side and a second side opposite from the first side, where the first side of FSS 1578 faces slot antenna 1574 and may have a structure such as described herein (e.g., a structure shown in FIG. 10 or FIG. 12). The first side of FSS 1578 is separated from slot antenna 1574 by a first defined distance, such as illustrated in FIG. 15. At least a portion of the radiation emitted by slot antenna 1574 passes through one or more horizontally oriented unit cells of FSS 1578, which includes one or more groups of cells that each includes multiple columns of one or more horizontally oriented unit cells. Patch antenna 1582 is configured to receive at least the portion of the radiation that passes through the horizontally oriented unit cells of FSS 1578.

Table 3 below lists and lays out the dimensions for the example of FIG. 15:

TABLE 3

DESIGN SPECIFICATIONS

| Variable | Value | Dimensions |
|---|---|---|
| h1 | 1.57 | mm |
| h2 | 1.25 | mm |
| h3 | 0.5 | mm |
| h4 | 12.5 | mm |
| h5 | 4.27 | mm |
| $\varepsilon_1$ | 2.2 | |
| Patch Dimensions | 9.88 × 7.65 | $mm^2$ |
| Slot Dimensions | 20 × 1.875 | $mm^2$ |
| Copper Thickness | 35 | μm |
| Box Dimensions | 27 × 27 × 21.5 | $mm^3$ |

The design in FIG. 15 shows that there is cavity-backed reflector 1570 placed below the slot, given that the slot may have a very high leakage since there is no ground plane on the bottom side. Cavity-backed reflector 1570 helps in reflecting the waves and directing them upwards towards FSS 1578. The distance between cavity-backed reflector 1570 and the slot (h5) can be set to ($\lambda/4$) so that the reflection preserves the phase of the signal. The height h4 can be set to ($\lambda/2$), which is an optimized value for enabling maximum radiation out of FSS 1578. By varying the shape of FSS 1578, the type of beams formed can be controlled.

Figure 16:
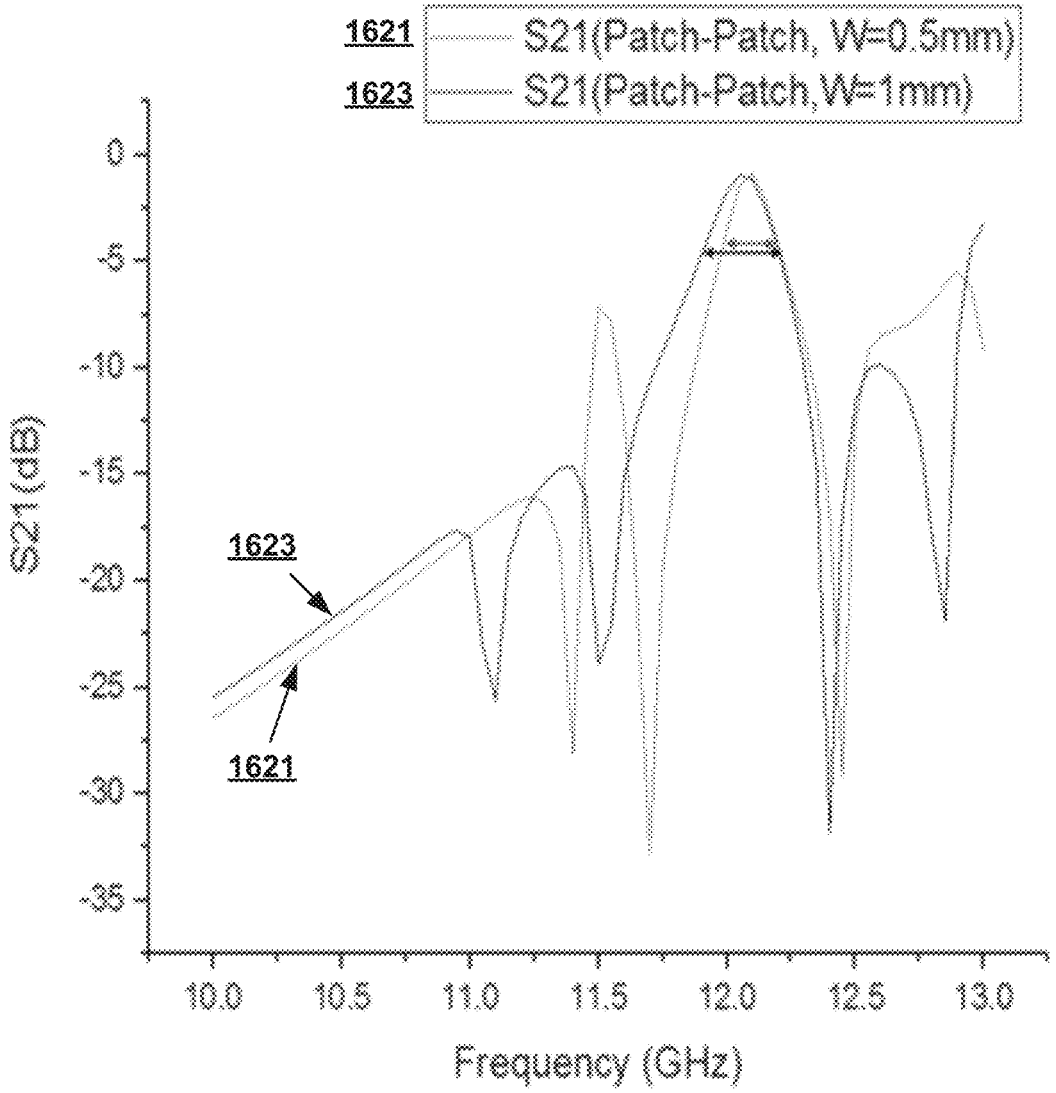
FIG. 16 is a diagram illustrating an example comparison of modelled results for different FSS slot widths, where a first curve indicates Patch-Patch design for slot width of 0.5 mm in the FSS, and where a second curve indicates Patch-Patch design for slot width of 1 mm in FSS, in accordance with one or more aspects of the present disclosure.
Figure 17:
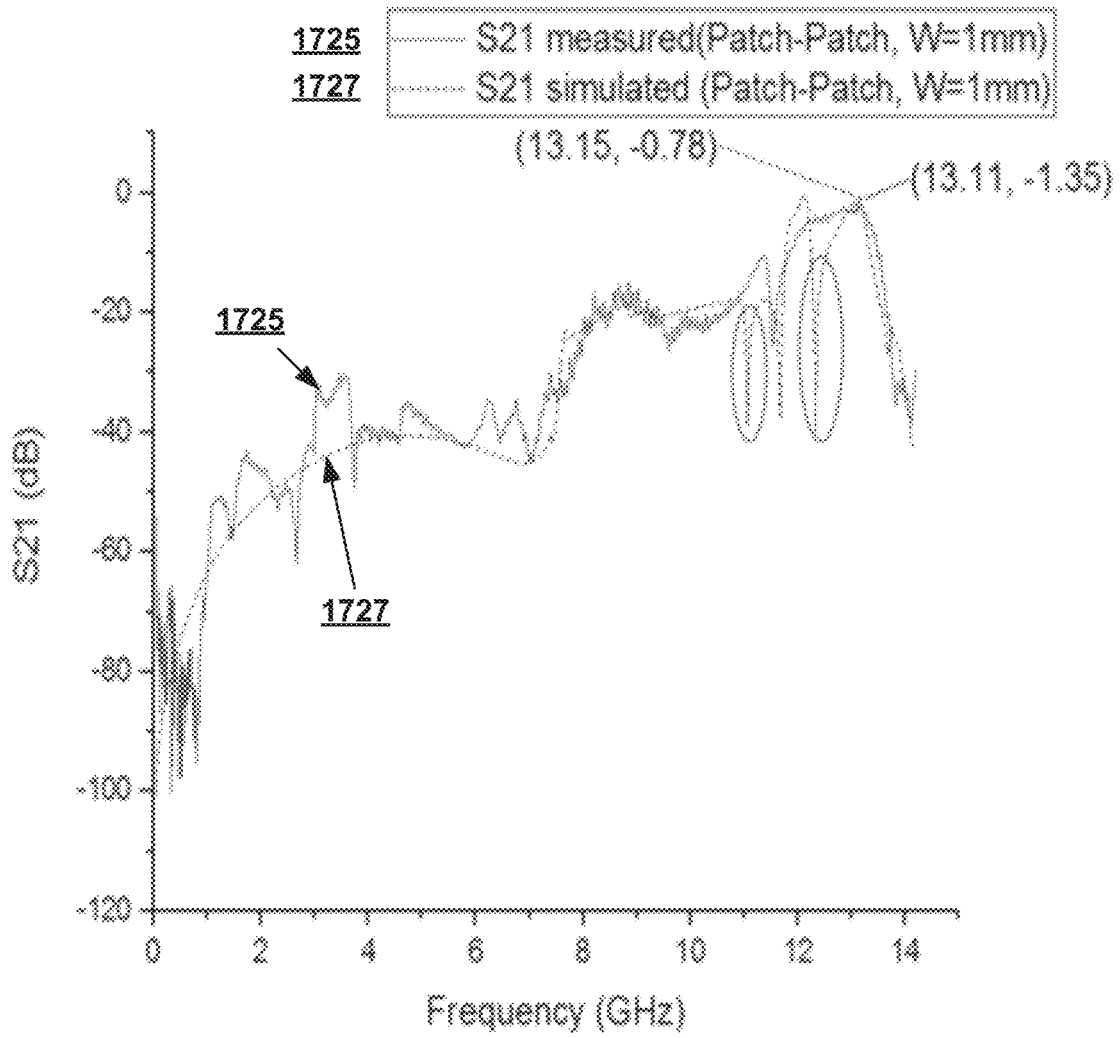
FIG. 17 is a diagram illustrating example measured versus simulated results for a one-beam patch transmitter and patch receiver system, where the two notches indicated by the displayed ovals in the simulated data, which do not appear in the measured data, increase the 3 dB bandwidth of the measured system to 6.67%, in accordance with one or more aspects of the present disclosure.

Referring again to the design illustrated in FIGS. 14A-14B, in non-limiting examples, at 12 GHz, the design has a bandwidth about 2.8% as indicated by the corresponding curve in FIG. 16. FIG. 16 is a diagram illustrating an example comparison of modelled results for different FSS slot widths, where a first curve 1621 indicates Patch-Patch design for slot width of 0.5 mm in the FSS, and where a second curve 1623 indicates Patch-Patch design for slot width of 1 mm in FSS, in accordance with one or more aspects of the present disclosure. When the slot width was increased from 0.5 mm to 1 mm, the bandwidth increased as shown in FIG. 17, as described further below. While both designs of slot width have similar response shapes, the original unit cell bandwidth of 2.8% is increased to 4% with the increased slot width, which may also alleviate the adjacent side notches.

In non-limiting examples, the vertical interconnects of the antenna system illustrated in FIGS. 14A-14B were measured using Anritsu 37369D VNA. A full two port calibration was performed before taking the measurements. The antennas were fed with SMA connectors and an inset fed microstrip line to patch antennas 1452 and 1466. The two antennas and FSS 1458 with slot width of 1 mm was fabricated using LPKF Protomat S103 Milling Machine. All simulations were performed using Ansys HFSS.

The vertical interconnect system was measured from DC to 15 GHz. FIG. 17 shows the comparison between the measured and the modelled results, where a first curve 1725 indicates measured results for a Patch-Patch design for slot width of 1 mm in FSS, and where a second curve 1727 indicates simulated results for a Patch-Patch design for slot width of 1 mm in FSS. FIG. 17 is a diagram illustrating example measured versus simulated results for a one-beam patch transmitter and patch receiver system, where the two notches indicated by the displayed ovals in the simulated data, which do not appear in the measured data, increase the 3 dB bandwidth of the measured system to 6.67%, in accordance with one or more aspects of the present disclosure. In simulation, the cavity was completely enclosed and leads to cavity resonances between 11 and 13 GHz shown as notches in the S21 measurement. In the fabricated system, there was leakage due to fabrication tolerances that suppress these resonances and result in a greater bandwidth.

Figure 18:
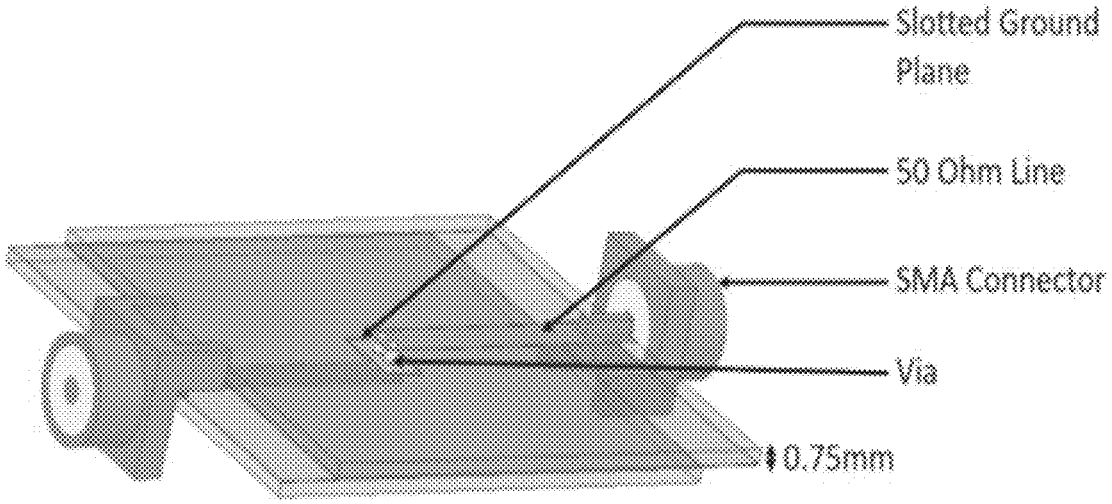
FIG. 18 is a diagram illustrating an example layer microstrip line implementation using two vias and slotted ground plane, where the line lengths of each of the 50 Ohm lines are 12.42 mm each, where the dimensions of the slot in ground plane are 4.11 mm by 2.53 mm, and where the via diameter is 0.7 mm for both the vias, in accordance with one or more aspects of the present disclosure.

For purposes of comparison, a two-layer back-to-back microstrip structure with vias was fabricated and testing. The structure consisted of two 50-ohm microstrip lines with ground planes touching each other. Slots were made in the ground planes to pass vias which connect both the lines. FIG. 18 illustrates the design of the complete structure. FIG. 18 is a diagram illustrating an example layer microstrip line implementation using two vias and slotted ground plane, where the line lengths of each of the 50 Ohm lines are 12.42 mm each, where the dimensions of the slot in ground plane are 4.11 mm by 2.53 mm, and where the via diameter is 0.7 mm for both the vias, in accordance with one or more aspects of the present disclosure.

Figure 19:
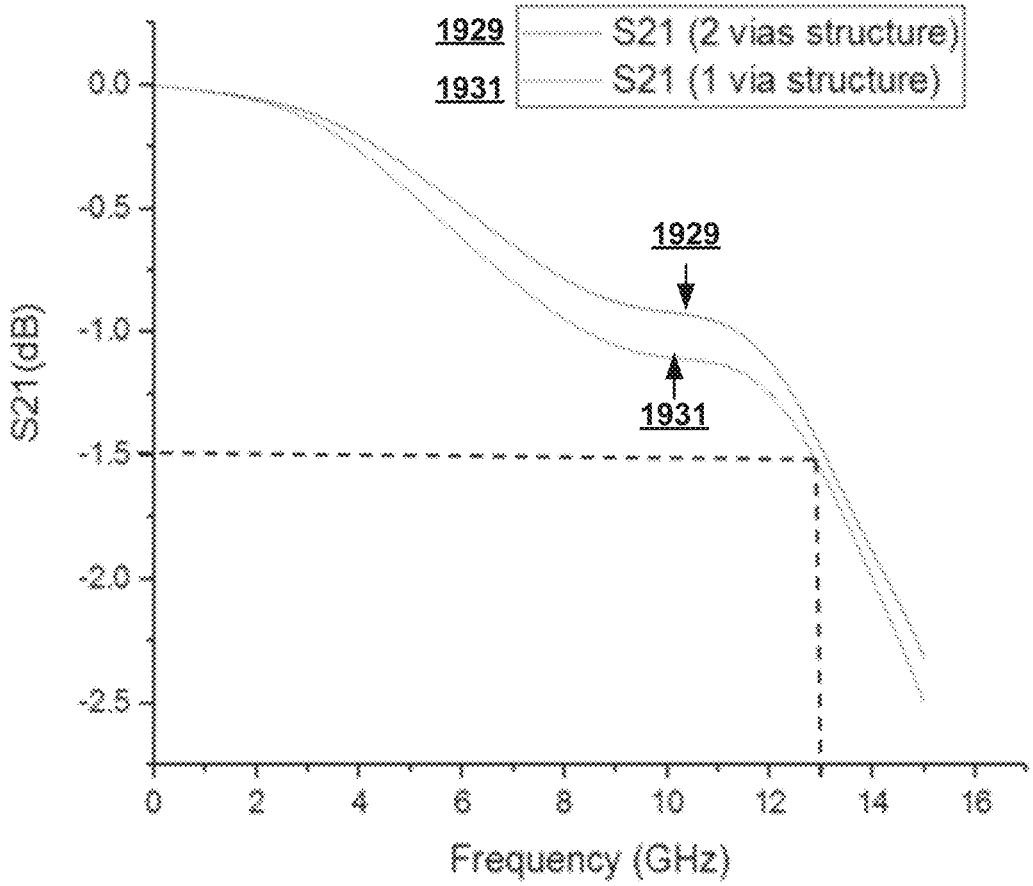
FIG. 19 is a diagram illustrating an example of a two-vias structure showing an improved modelled performance, where the value of S21 at 13 GHz where the patch-patch structure performs the best is −1.5 dB, in accordance with one or more aspects of the present disclosure.
Figure 20:
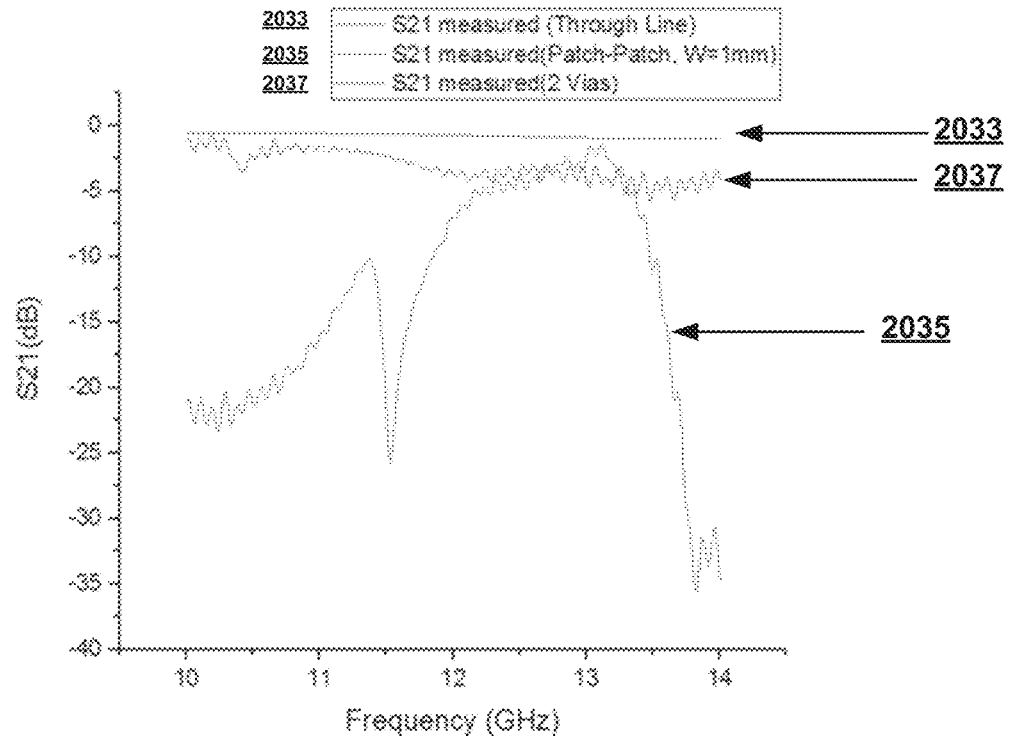
FIG. 20 is a diagram illustrating an example comparison of measured S21 between the through line, via and patch-patch wireless interconnect system, in accordance with one or more aspects of the present disclosure.

The simulated performance of two vias (curve 1929) compared to a single via (curve 1931) is shown in FIG. 19. FIG. 19 is a diagram illustrating an example of a two-vias structure showing a modelled performance, where the value of S21 at 13 GHz where the patch-patch structure performs the best is −1.5 dB, in accordance with one or more aspects of the present disclosure. The design with two vias had better transmission response than the design with a single via. Thus, the structure with two vias was fabricated and measured. FIG. 20 shows the comparison of the measured coefficient for the presently disclosed design, planar through line and the vertically connected through lines using the two via structure. FIG. 20 illustrates an example comparison of measured S21 between the through line (curve 2033), via (curve 2037), and patch-patch wireless interconnect system (curve 2035), in accordance with one or more aspects of the present disclosure. The insertion loss of the two via design was 2.64 dB worse than the free space interconnect design described in the present disclosure. For a single board, half of the via loss is also higher than the proposed model results.

Figure 21:
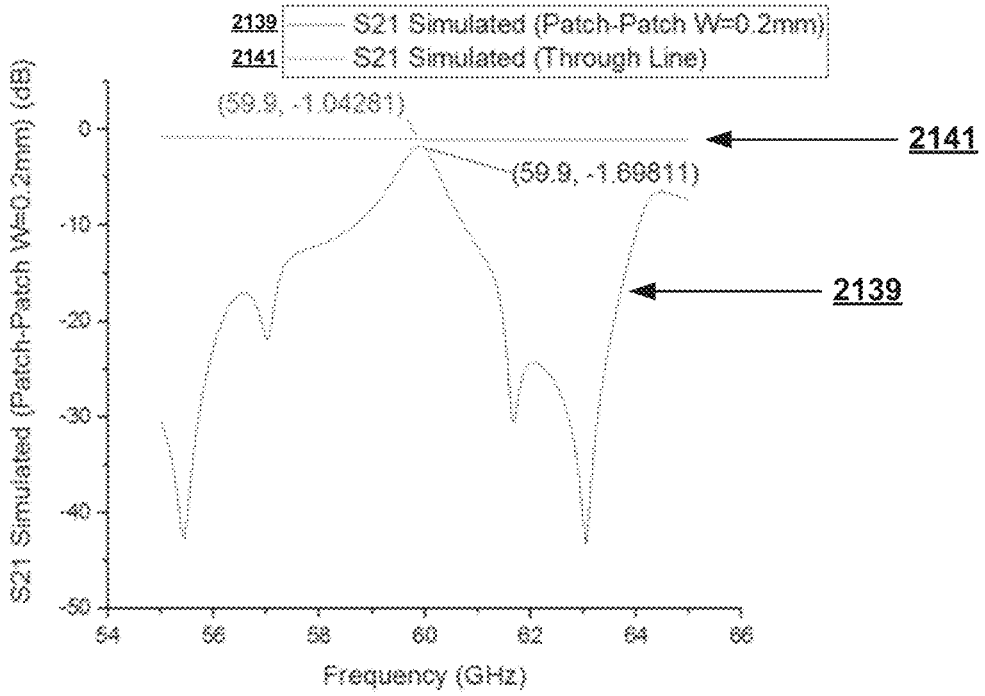
FIG. 21 is a diagram illustrating an example S21 performance for the scaled wireless interconnect system with patch transmitter and receiver compared with simulated through line performance, in accordance with one or more aspects of the present disclosure.

In various examples, regarding scalability of the 12 GHz model, the designs presented herein may be used with, e.g., 60 GHz (or higher) applications. A 60 GHz design may be modelled based on the work presented herein. In non-limiting examples, all dimensions are reduced by a factor of five including board thickness. The board material remains Duroid 5880. In the model, the SMA connectors are replaced with V-connectors. In FIG. 21, at 60 GHz the bandwidth is around 2%. Using a preliminary optimization, at least 4% bandwidth is observed, which is similar to the results of the 12 GHz scale model. FIG. 21 illustrates an example S21 performance for the scaled wireless interconnect system with patch transmitter and receiver (curve 2139) compared with simulated through line performance (curve 2141), in accordance with one or more aspects of the present disclosure.

As presented herein, according to various non-limiting examples, a novel free space vertical interconnect is developed by coupling a patch to the near-field focused beam of a patch FPCA. The scale model structure operates at 12 GHz and has a measured insertion loss of 1.34 dB. It is compared to a through line at the operating frequency that has a 0.9 dB insertion loss and to a back-to-back microstrip with two substrates that are connected by two vias. The back-to-back design has an insertion loss of 4 dB. Via loss is expected to be prohibitive at 60 GHz and higher, and therefore the techniques presented herein may be used in 3D integrated systems that can benefit from high isolation, near-field chip-to-chip communication at or around/above this frequency. In addition to the results at 60 GHz design, the design footprint shrinks and alleviates metal loses associated with higher resistance of via based vertical interconnects. In various examples, and as described herein, both a slot and a patch antenna may also be used in the antenna system.

The following numbered examples may illustrate one or more aspects of the present Example 1

An antenna system, comprising: a source antenna; a frequency selective surface (FSS) having a first side and a second side opposite from the first side, wherein the first side of the FSS includes a plurality of horizontally oriented unit cells, wherein the horizontally oriented unit cells are positioned as multiple columns of unit cells on the first side of the FSS, wherein the first side of the FSS faces the source antenna, and wherein the first side of the FSS is separated from the source antenna by a defined distance; and a housing that includes a fluidic channel, wherein the housing is positioned on the second side of the FSS, wherein the fluidic channel includes one of air or deionized water, and wherein the fluidic channel is positioned on a portion of the second side of the FSS that is opposite to a subset of the horizontally oriented unit cells on the first side of the FSS.

Example 2

The antenna system of Example 1, wherein the antenna system is Fabry-Perot Cavity (FPC) antenna system, and wherein the antenna system further comprises: a cavity-backed reflector that is separated from the source antenna by a defined cavity; and at least one metallic sidewall that is coupled to one or more of the cavity-backed reflector, the source antenna, or the FSS.

Example 3

The antenna system of any of Examples 1-2, wherein the source antenna comprises a slot dipole antenna, and wherein the antenna system further comprises: a coplanar waveguide (CPW) feedline that is configured to feed the slot dipole antenna.

Example 4

The antenna system of any of Examples 1-3, wherein the fluidic channel in the housing contains air, and wherein the horizontally oriented unit cells positioned as multiple columns of unit cells on the first side of the FSS, in conjunction with and the fluidic channel in the housing positioned on the second side of the FSS, are configured to perform beam focusing of radiation that is emitted by the source antenna.

Example 5

The antenna system of any of Examples 1-3, wherein the fluidic channel in the housing contains deionized water, and wherein the horizontally oriented unit cells positioned as multiple columns of unit cells on the first side of the FSS, in conjunction with and the fluidic channel in the housing positioned on the second side of the FSS, are configured to perform beam-splitting of radiation that is emitted by the source antenna.

Example 6

The antenna system of any of Examples 1-5, wherein the subset of the horizontally oriented unit cells on the first side of the FSS are positioned substantially along a center portion of the first side of the FSS, and wherein the fluidic channel is positioned on the portion of the second side of the FSS that is substantially opposite the center portion of the first side of the FSS.

Example 7

The antenna system of any of Examples 1-6, wherein the subset of the horizontally oriented unit cells on the first side of the FSS includes at least one of the multiple columns of unit cells on the first side of the FSS, and wherein the fluidic channel is positioned on the portion of the second side of the FSS that is substantially opposite to the at least one of the multiple columns of unit cells on the first side of the FSS.

Example 8

The antenna system of Example 7, wherein the multiple columns of unit cells on the first side of the FSS include nine columns of unit cells, wherein each of the nine columns of unit cells includes twenty-seven individual horizontally oriented unit cells, wherein the subset of the horizontally oriented unit cells on the first side of the FSS includes a particular column of the nine columns of unit cells, and wherein the fluidic channel is positioned on the portion of the second side of the FSS that is substantially opposite to the particular column of unit cells on the first side of the FSS.

Example 9

The antenna system of Example 8, wherein the particular column of unit cells comprises a middle column within the nine columns of unit cells.

Example 10

The antenna system of any of Examples 1-9, wherein each of the horizontally oriented unit cells includes a rectangular-shaped aperture that is positioned substantially in a center of the respective horizontally oriented unit cell.

Example 11

The antenna system of any of Examples 1-10, wherein the fluidic channel in the housing has a width of 8 millimeters.

Example 12

The antenna system of any of Examples 1-10, wherein the fluidic channel in the housing has a width of 10 millimeters.

Example 13

The antenna system of any of Examples 1-12, wherein the housing is made of polydimethylsiloxane (PDMS).

Example 14

The antenna system of any of Examples 1-13, further comprising a pump that is configured to fill the fluidic channel of the housing with the one of air or deionized water.

Example 15

A method comprising: configuring an antenna system to operate in a first mode, wherein the first mode comprises one of a beam-splitting mode or a beam-focusing mode, and wherein the antenna system comprises: a source antenna; a frequency selective surface (FSS) having a first side and a second side opposite from the first side, wherein the first side of the FSS includes a plurality of horizontally oriented unit cells, wherein the horizontally oriented unit cells are positioned as multiple columns of unit cells on the first side of the FSS, wherein the first side of the FSS faces the source antenna, and wherein the first side of the FSS is separated from the source antenna by a defined distance; and a housing that includes a fluidic channel, wherein the housing is positioned on the second side of the FSS, wherein the fluidic channel includes one of air or deionized water, and wherein the fluidic channel is positioned on a portion of the second side of the FSS that is opposite to a subset of the horizontally oriented unit cells on the first side of the FSS; and subsequent to the antenna system operating in the first mode for a duration of time, reconfiguring the antenna system to operate in a second mode, wherein the second mode comprises one of the beam-splitting mode or the beam-focusing mode, wherein the second mode is different from the first mode, and wherein configuring the antenna system to operate in the first mode and reconfiguring the antenna system to operate in the second mode each comprise filling the fluidic channel of the housing with one of air or deionized water.

Example 16

The method of Example 15, wherein configuring the antenna system to operate in the first mode comprises filling the fluidic channel of the housing with deionized water, wherein the first mode comprises the beam-splitting mode, and wherein, while in the beam-splitting mode, the horizontally oriented unit cells positioned as multiple columns of unit cells on the first side of the FSS, in conjunction with and the fluidic channel in the housing positioned on the second side of the FSS, are configured to perform beam-splitting of radiation that is emitted by the source antenna.

Example 17

The method of Example 15, wherein reconfiguring the antenna system to operate in the second mode comprises filling the fluidic channel of the housing with air, wherein the second mode comprises the beam-focusing mode, and wherein, while in the beam-focusing mode, the horizontally oriented unit cells positioned as multiple columns of unit cells on the first side of the FSS, in conjunction with and the fluidic channel in the housing positioned on the second side of the FSS, are configured to perform beam focusing of radiation that is emitted by the source antenna.

Example 18

The method of any of Examples 15-17, wherein the antenna system is Fabry-Perot Cavity (FPC) antenna system, and wherein the antenna system further comprises a cavity-backed reflector that is separated from the source antenna by a defined cavity, and at least one metallic sidewall that is coupled to one or more of the cavity-backed reflector, the source antenna, or the FSS.

Example 19

The method of any of Examples 15-18, wherein the source antenna comprises a slot dipole antenna, and wherein the antenna system further comprises a coplanar waveguide (CPW) feedline that is configured to feed the slot dipole antenna.

Example 20

The method of any of Examples 15-19, wherein the subset of the horizontally oriented unit cells on the first side of the FSS are positioned substantially along a center portion of the first side of the FSS, and wherein the fluidic channel is positioned on the portion of the second side of the FSS that is opposite the center portion of the first side of the FSS.

Example 21

The method of any of Examples 15-20, wherein the subset of the horizontally oriented unit cells on the first side of the FSS includes at least one of the multiple columns of unit cells on the first side of the FSS, and wherein the fluidic channel is positioned on the portion of the second side of the FSS that is opposite to the at least one of the multiple columns of unit cells on the first side of the FSS.

Example 22

The method of Example 21, wherein the multiple columns of unit cells on the first side of the FSS include nine columns of unit cells, wherein each of the nine columns of unit cells includes twenty-seven individual horizontally oriented unit cells, wherein the subset of the horizontally oriented unit cells on the first side of the FSS includes a particular column of the nine columns of unit cells, and wherein the fluidic channel is positioned on the portion of the second side of the FSS that is opposite to the particular column of unit cells on the first side of the FSS.

Example 23

The method of Example 22, wherein the particular column of unit cells comprises a middle column within the nine columns of unit cells.

Example 24

The method of any of Examples 15-23, wherein each of the horizontally oriented unit cells includes a rectangular-shaped aperture that is positioned substantially in a center of the respective horizontally oriented unit cell.

Example 25

The method of any of Examples 15-24, wherein the fluidic channel in the housing has a width of 8 millimeters.

Example 26

The method of any of Examples 15-24, wherein the fluidic channel in the housing has a width of 10 millimeters.

Example 27

The method of any of Examples 15-26, wherein the housing is made of polydimethylsiloxane (PDMS).

Example 28

An antenna system configured to perform the method of any of Examples 15-27.

Example 29

An antenna system comprising means for performing the method of any of Examples 15-27.

Example 30

A Fabry-Perot Cavity (FPC) antenna system, comprising: a transmit antenna that is configured to emit radiation, a frequency selective surface (FSS) having a first side and a second side opposite from the first side, wherein the first side of the FSS faces the transmit antenna and includes a plurality of horizontally oriented unit cells, wherein the first side of the FSS is separated from the transmit antenna by a first defined distance, wherein at least a portion of the radiation emitted by the transmit antenna passes through the plurality of horizontally oriented unit cells, and wherein the plurality of horizontally oriented unit cells includes one or more groups of cells that each includes multiple columns of one or more horizontally oriented unit cells; a receive antenna that is configured to receive at least the portion of the radiation that passes through the plurality of horizontally oriented unit cells of the FSS, wherein the receive antenna faces the second side of the FSS and is separated from the second side of the FSS by a second defined distance, and wherein the FSS is positioned between the transmit antenna and the receive antenna; and an enclosure that is configured to at least partially enclose the transmit antenna, the FSS, and the receive antenna.

Example 31

The FPC antenna system of Example 30, wherein the enclosure comprises a plurality of metal-coated sidewalls.

Example 32

The FPC antenna system of any of Examples 30-31, wherein the one or more groups of cells includes a plurality of groups of horizontally oriented unit cells that are configured to perform beam splitting of the radiation that is emitted by the source antenna.

Example 33

The FPC antenna system of Example 32, wherein the plurality of groups of horizontally oriented unit cells comprises four groups of horizontally oriented unit cells, wherein each of the four groups includes three columns of horizontally oriented unit cells, and wherein each of the three columns includes nine horizontally oriented unit cells.

Example 34

The FPC antenna system of Example 32, wherein the receive antenna comprises a first receive antenna that is configured to receive at least a first portion of the radiation that passes through a first group of the plurality of groups of horizontally oriented unit cells, and wherein the FPC antenna system further includes a second receive antenna that faces the second side of the FSS and that is configured to receive at least a second portion of the radiation that passes through a second group of the plurality of horizontally oriented unit cells.

Example 35

The FPC antenna system of Example 32, wherein each group of the plurality of groups of horizontally oriented unit cells is separated from another group of the plurality of groups of horizontally oriented unit cells by a respective plurality of vertically oriented unit cells.

Example 36

The FPC antenna system of any of Examples 30-35, wherein each of the one or more groups of cells is surrounded by a plurality of vertically oriented unit cells.

Example 37

The FPC antenna system of any of Examples 30-36, wherein the transmit antenna comprises a first patch antenna and a first substrate, the first patch antenna being positioned between the first substrate and the FSS, and wherein the receive antenna comprises a second patch antenna and a second substrate, the second patch antenna being positioned between the second substrate and the FSS.

Example 38

The FCP antenna system of any of Examples 30-37, wherein the transmit antenna comprises a slot antenna, a microstrip feed, and a cavity-backed reflector, wherein the microstrip feed is positioned between the cavity-backed reflector and the slot antenna, wherein the receive antenna comprises a patch antenna, a substrate, and a ground plane, and wherein the substrate is positioned between the ground plane and the patch antenna.

Example 39

The FPC antenna system of any of Examples 30-38, wherein the transmit antenna is included on at least a first integrated circuit, wherein the receive antenna is included on at least a second integrated circuit, and wherein the FPC antenna system enables chip-to-chip communication between at least the first integrated circuit and the second integrated circuit in a multi-chip system.

Example 40

The FPC antenna system of any of Examples 30-39, wherein each of the plurality of horizontally oriented unit cells includes a rectangular-shaped aperture that is positioned substantially in a center of the respective horizontally oriented unit cell.

Example 41

A method of providing wireless communication in a Fabry-Perot Cavity (FPC) antenna system, the method comprising: emitting, by a transmit antenna of the FPC antenna system, radiation that at least partially passes through a frequency selective surface (FSS) having a first side and a second side opposite from the first side, wherein the first side of the FSS faces the transmit antenna and includes a plurality of horizontally oriented unit cells, wherein the first side of the FSS is separated from the transmit antenna by a first defined distance, wherein at least a portion of the radiation emitted by the transmit antenna passes through the plurality of horizontally oriented unit cells, and wherein the horizontally oriented unit cells include one or more groups of cells that each includes multiple columns of one or more horizontally oriented unit cells; and receiving, by a receive antenna of the FPC antenna system, at least the portion of the radiation that passes through the plurality of horizontally oriented unit cells of the FSS, wherein the receive antenna faces the second side of the FSS and is separated from the second side of the FSS by a second defined distance, and wherein the FSS is positioned between the transmit antenna and the receive antenna.

Example 42

The method of Example 41, wherein the one or more groups of cells includes a plurality of groups of horizontally oriented unit cells, wherein at least the portion of the radiation received by the receive antenna of the FPC antenna system includes at least first and second portions of the radiation, and wherein the method further comprises: splitting, by the plurality of groups of horizontally oriented unit cells, the radiation emitted by the transmit antenna into at least the first and second portions of the radiation.

Example 43

The method of Example 42, wherein the receive antenna of the FPC antenna system comprises a first receive antenna, wherein the FCP antenna system comprises a second receive antenna that faces the second side of the FSS, wherein the plurality of groups of horizontally oriented unit cells includes a first group and a second group, and wherein the method further comprises: receiving, by the first receive antenna of the FPC antenna system, at least the first portion of the radiation that passes through the first group of the plurality of groups of horizontally oriented unit cells; and receiving, by the second receive antenna of the FPC antenna system, at least the second portion of the radiation that passes through the second group of the plurality of horizontally oriented unit cells.

Example 44

The method of any of Examples 41-43, wherein the transmit antenna of the FPC antenna system is included on at least a first integrated circuit, wherein the receive antenna of the FPC antenna system is included on at least a second integrated circuit, and wherein receiving, by the receive antenna, at least the portion of the radiation that is emitted by the transmit antenna and that passes through the plurality of horizontally oriented unit cells of the FSS enables chip-to-chip communication between at least the first integrated circuit and the second integrated circuit.

Example 45

An antenna system configured to perform the method of any of Examples 41-44.

Example 46

An antenna system comprising means for performing the method of any of Examples 41-44.

It is to be recognized that depending on the example, certain acts or events of any of the techniques described herein can be performed in a different sequence, may be added, merged, or left out altogether (e.g., not all described acts or events are necessary for the practice of the techniques). Moreover, in certain examples, acts or events may be performed concurrently, e.g., through multi-threaded processing, interrupt processing, or multiple processors, rather than sequentially.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise random-access memory (RAM), read-only memory (ROM), electrically erasable programmable read-only memory (EEPROM), compact disc read-only memory (CD-ROM), or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transitory media, but are instead directed to non-transitory, tangible storage media. Disk and disc, as used herein, includes compact disc, laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSP's), general purpose microprocessors, application specific integrated circuits (ASIC's), field programmable logic arrays (FPGA's), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of IC's (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various examples of the disclosure have been described. Any combination of the described systems, operations, or functions is contemplated. These and other examples are within the scope of the following claims.

What is claimed is:

1. An antenna system, comprising:

a source antenna;

a frequency selective surface (FSS) having a first side and a second side opposite from the first side, wherein the first side of the FSS includes a plurality of horizontally oriented unit cells, wherein the horizontally oriented unit cells are positioned as multiple columns of unit cells on the first side of the FSS, wherein the first side of the FSS faces the source antenna, and wherein the first side of the FSS is separated from the source antenna by a defined distance; and a housing that includes a fluidic channel, wherein the housing is positioned on the second side of the FSS, wherein the fluidic channel includes one of air or deionized water, and wherein the fluidic channel is positioned on a portion of the second side of the FSS that is opposite to a subset of the horizontally oriented unit cells on the first side of the FSS.

2. The antenna system of claim 1, wherein the antenna system is Fabry-Perot Cavity (FPC) antenna system, and wherein the antenna system further comprises:

a cavity-backed reflector that is separated from the source antenna by a defined cavity; and at least one metallic sidewall that is coupled to one or more of the cavity-backed reflector, the source antenna, or the FSS.

3. The antenna system of claim 1, wherein the source antenna comprises a slot dipole antenna, and wherein the antenna system further comprises:

a coplanar waveguide (CPW) feedline that is configured to feed the slot dipole antenna.

4. The antenna system of claim 1, wherein the fluidic channel in the housing contains air, and wherein the horizontally oriented unit cells positioned as multiple columns of unit cells on the first side of the FSS, in conjunction with and the fluidic channel in the housing positioned on the second side of the FSS, are configured to perform beam focusing of radiation that is emitted by the source antenna.

5. The antenna system of claim 1, wherein the fluidic channel in the housing contains deionized water, and wherein the horizontally oriented unit cells positioned as multiple columns of unit cells on the first side of the FSS, in conjunction with and the fluidic channel in the housing positioned on the second side of the FSS, are configured to perform beam splitting of radiation that is emitted by the source antenna.

6. The antenna system of claim 1, wherein the subset of the horizontally oriented unit cells on the first side of the FSS are positioned substantially along a center portion of the first side of the FSS, and wherein the fluidic channel is positioned on the portion of the second side of the FSS that is substantially opposite the center portion of the first side of the FSS.

7. The antenna system of claim 1, wherein the subset of the horizontally oriented unit cells on the first side of the FSS includes at least one of the multiple columns of unit cells on the first side of the FSS, and wherein the fluidic channel is positioned on the portion of the second side of the FSS that is substantially opposite to the at least one of the multiple columns of unit cells on the first side of the FSS.

8. The antenna system of claim 7, wherein the multiple columns of unit cells on the first side of the FSS include nine columns of unit cells, wherein each of the nine columns of unit cells includes twenty-seven individual horizontally oriented unit cells, wherein the subset of the horizontally oriented unit cells on the first side of the FSS includes a particular column of the nine columns of unit cells, and wherein the fluidic channel is positioned on the portion of the second side of the FSS that is substantially opposite to the particular column of unit cells on the first side of the FSS.

9. The antenna system of claim 8, wherein the particular column of unit cells comprises a middle column within the nine columns of unit cells.

10. The antenna system of claim 1, wherein each of the horizontally oriented unit cells includes a rectangular-shaped aperture that is positioned substantially in a center of the respective horizontally oriented unit cell.

11. The antenna system of claim 1, wherein the fluidic channel in the housing has a width of 8 millimeters.

12. The antenna system of claim 1, wherein the fluidic channel in the housing has a width of 10 millimeters.

13. The antenna system of claim 1, wherein the housing is made of polydimethylsiloxane (PDMS).

14. The antenna system of claim 1, further comprising a pump that is configured to fill the fluidic channel of the housing with the one of air or deionized water.

15. A method comprising:

configuring an antenna system to operate in a first mode, wherein the first mode comprises one of a beam-splitting mode or a beam-focusing mode, and wherein the antenna system comprises:

a source antenna;

a frequency selective surface (FSS) having a first side and a second side opposite from the first side, wherein the first side of the FSS includes a plurality of horizontally oriented unit cells, wherein the horizontally oriented unit cells are positioned as multiple columns of unit cells on the first side of the FSS, wherein the first side of the FSS faces the source antenna, and wherein the first side of the FSS is separated from the source antenna by a defined distance; and a housing that includes a fluidic channel, wherein the housing is positioned on the second side of the FSS, wherein the fluidic channel includes one of air or deionized water, and wherein the fluidic channel is positioned on a portion of the second side of the FSS that is opposite to a subset of the horizontally oriented unit cells on the first side of the FSS; and subsequent to the antenna system operating in the first mode for a duration of time, reconfiguring the antenna system to operate in a second mode, wherein the second mode comprises one of the beam-splitting mode or the beam-focusing mode, wherein the second mode is different from the first mode, and wherein configuring the antenna system to operate in the first mode and reconfiguring the antenna system to operate in the second mode each comprise filling the fluidic channel of the housing with one of air or deionized water.

16. The method of claim 15, wherein configuring the antenna system to operate in the first mode comprises filling the fluidic channel of the housing with deionized water, wherein the first mode comprises the beam-splitting mode, and wherein, while in the beam-splitting mode, the horizontally oriented unit cells positioned as multiple columns of unit cells on the first side of the FSS, in conjunction with and the fluidic channel in the housing positioned on the second side of the FSS, are configured to perform beam-splitting of radiation that is emitted by the source antenna.

17. The method of claim 15, wherein reconfiguring the antenna system to operate in the second mode comprises filling the fluidic channel of the housing with air, wherein the second mode comprises the beam-focusing mode, and wherein, while in the beam-focusing mode, the horizontally oriented unit cells positioned as multiple columns of unit cells on the first side of the FSS, in conjunction with and the fluidic channel in the housing positioned on the second side of the FSS, are configured to perform beam focusing of radiation that is emitted by the source antenna.

18. The method of claim 15, wherein the antenna system is Fabry-Perot Cavity (FPC) antenna system, and wherein the antenna system further comprises a cavity-backed reflector that is separated from the source antenna by a defined cavity, and at least one metallic sidewall that is coupled to one or more of the cavity-backed reflector, the source antenna, or the FSS.

19. The method of claim 15, wherein the source antenna comprises a slot dipole antenna, and wherein the antenna system further comprises a coplanar waveguide (CPW) feedline that is configured to feed the slot dipole antenna.

20. The method of claim 15, wherein the subset of the horizontally oriented unit cells on the first side of the FSS are positioned substantially along a center portion of the first side of the FSS, and wherein the fluidic channel is positioned on the portion of the second side of the FSS that is opposite the center portion of the first side of the FSS.

21. An antenna system, comprising:

a transmit antenna that is configured to emit radiation;

a frequency selective surface (FSS) having a first side and a second side opposite from the first side, wherein the first side of the FSS faces the transmit antenna and includes a plurality of horizontally oriented unit cells, wherein the first side of the FSS is separated from the transmit antenna by a first defined distance, wherein at least a portion of the radiation emitted by the transmit antenna passes through the plurality of horizontally oriented unit cells, and wherein the plurality of horizontally oriented unit cells includes one or more groups of cells that each includes multiple columns of one or more horizontally oriented unit cells;

a receive antenna that is configured to receive at least the portion of the radiation that passes through the plurality of horizontally oriented unit cells of the FSS, wherein the receive antenna faces the second side of the FSS and is separated from the second side of the FSS by a second defined distance, and wherein the FSS is positioned between the transmit antenna and the receive antenna; and an enclosure that is configured to at least partially enclose the transmit antenna, the FSS, and the receive antenna.

22. The antenna system of claim 21, wherein the enclosure comprises a plurality of metal-coated sidewalls.

23. The antenna system of claim 21, wherein the one or more groups of cells includes a plurality of groups of horizontally oriented unit cells that are configured to perform beam splitting of the radiation that is emitted by the transmit antenna.

24. The antenna system of claim 23, wherein the plurality of groups of horizontally oriented unit cells comprises four groups of horizontally oriented unit cells, wherein each of the four groups includes three columns of horizontally oriented unit cells, and wherein each of the three columns includes nine horizontally oriented unit cells.

25. The antenna system of claim 23, wherein the receive antenna comprises a first receive antenna that is configured to receive at least a first portion of the radiation that passes through a first group of the plurality of groups of horizontally oriented unit cells, and wherein the antenna system further includes a second receive antenna that faces the second side of the FSS and that is configured to receive at least a second portion of the radiation that passes through a second group of the plurality of horizontally oriented unit cells.

26. The antenna system of claim 23, wherein each group of the plurality of groups of horizontally oriented unit cells is separated from another group of the plurality of groups of horizontally oriented unit cells by a respective plurality of vertically oriented unit cells.

27. The antenna system of claim 21, wherein each of the one or more groups of cells is surrounded by a plurality of vertically oriented unit cells.

28. The antenna system of claim 21, wherein the transmit antenna comprises a first patch antenna and a first substrate, the first patch antenna being positioned between the first substrate and the FSS, and wherein the receive antenna comprises a second patch antenna and a second substrate, the second patch antenna being positioned between the second substrate and the FSS.

29. The antenna system of claim 21, wherein the transmit antenna comprises a slot antenna, a microstrip feed, and a cavity-backed reflector, wherein the microstrip feed is positioned between the cavity-backed reflector and the slot antenna, wherein the receive antenna comprises a patch antenna, a substrate, and a ground plane, and wherein the substrate is positioned between the ground plane and the patch antenna.

30. The antenna system of claim 21, wherein the transmit antenna is included on at least a first integrated circuit, wherein the receive antenna is included on at least a second integrated circuit, and wherein the antenna system enables chip-to-chip communication between at least the first integrated circuit and the second integrated circuit in a multi-chip system.

31. The antenna system of claim 21, wherein each of the plurality of horizontally oriented unit cells includes a rectangular-shaped aperture that is positioned substantially in a center of the respective horizontally oriented unit cell.

32. A method of providing wireless communication in an antenna system, the method comprising:

emitting, by a transmit antenna of the antenna system, radiation that at least partially passes through a frequency selective surface (FSS) having a first side and a second side opposite from the first side, wherein the first side of the FSS faces the transmit antenna and includes a plurality of horizontally oriented unit cells, wherein the first side of the FSS is separated from the transmit antenna by a first defined distance, wherein at least a portion of the radiation emitted by the transmit antenna passes through the plurality of horizontally oriented unit cells, and wherein the horizontally oriented unit cells include one or more groups of cells that each includes multiple columns of one or more horizontally oriented unit cells; and receiving, by a receive antenna of the antenna system, at least the portion of the radiation that passes through the plurality of horizontally oriented unit cells of the FSS, wherein the receive antenna faces the second side of the FSS and is separated from the second side of the FSS by a second defined distance, and wherein the FSS is positioned between the transmit antenna and the receive antenna.

33. The method of claim 32, wherein the one or more groups of cells includes a plurality of groups of horizontally oriented unit cells, wherein at least the portion of the radiation received by the receive antenna of the antenna system includes at least first and second portions of the radiation, and wherein the method further comprises:

splitting, by the plurality of groups of horizontally oriented unit cells, the radiation emitted by the transmit antenna into at least the first and second portions of the radiation.

34. The method of claim 33, wherein the receive antenna of the antenna system comprises a first receive antenna, wherein the FCP antenna system comprises a second receive antenna that faces the second side of the FSS, wherein the plurality of groups of horizontally oriented unit cells includes a first group and a second group, and wherein the method further comprises:

receiving, by the first receive antenna of the antenna system, at least the first portion of the radiation that passes through the first group of the plurality of groups of horizontally oriented unit cells; and receiving, by the second receive antenna of the antenna system, at least the second portion of the radiation that passes through the second group of the plurality of horizontally oriented unit cells.

35. The method of claim 32, wherein the transmit antenna of the antenna system is included on at least a first integrated circuit, wherein the receive antenna of the antenna system is included on at least a second integrated circuit, and wherein receiving, by the receive antenna, at least the portion of the radiation that is emitted by the transmit antenna and that passes through the plurality of horizontally oriented unit cells of the FSS enables chip-to-chip communication between at least the first integrated circuit and the second integrated circuit.

* * * * *